US006142002A

United States Patent [19]

Itaya

[11] Patent Number: 6,142,002

[45] Date of Patent: Nov. 7, 2000

[54] SPRING MANUFACTURING APPARATUS AND TOOL SELECTION APPARATUS

[75] Inventor: Ichiro Itaya, Tokyo, Japan

[73] Assignee: Kabushiki Kaisha Itaya Seisaku Sho, Tokyo, Japan

[21] Appl. No.: 09/373,404

[22] Filed: Aug. 12, 1999

[30] Foreign Application Priority Data

Aug. 21, 1998 [JP] Japan ..... 10-235962

[51] Int. Cl.[7] ..... B21F 35/02; B21F 3/02; B21F 3/04

[52] U.S. Cl. ..... 72/137; 72/145; 72/140

[58] Field of Search ..... 72/135, 137, 138, 72/140, 143, 145, 131, 132, 134

[56] References Cited

U.S. PATENT DOCUMENTS

| | | |
|---|---|---|
| 642,339 | 1/1900 | Krummel . |
| 3,161,224 | 12/1964 | Hediger . |
| 3,427,838 | 2/1969 | Rimmer . |
| 3,456,470 | 7/1969 | Dawes . |
| 3,906,766 | 9/1975 | Sato . |
| 3,934,445 | 1/1976 | Lampielti . |
| 4,173,135 | 11/1979 | Lampielti . |

(List continued on next page.)

FOREIGN PATENT DOCUMENTS

| | | |
|---|---|---|
| 41 32 317 C1 | 8/1992 | Germany . |
| 43 23 009 | 1/1994 | Germany . |
| 1254927 | 10/1995 | Italy . |
| 1254928 | 10/1995 | Italy . |
| 1254929 | 10/1995 | Italy . |
| 48-47828 | 10/1971 | Japan . |
| 52-30727 | 8/1975 | Japan . |
| 52-40633 | 10/1977 | Japan . |
| 54-15032 | 1/1979 | Japan . |
| 54-52661 | 4/1979 | Japan . |
| 54-52662 | 4/1979 | Japan . |
| 57-11743 | 1/1982 | Japan . |
| 59-92136 | 5/1984 | Japan . |
| 59-92138 | 5/1984 | Japan . |
| 59-144542 | 8/1984 | Japan . |
| 61-190326 | 11/1986 | Japan . |
| 63-157444 | 3/1987 | Japan . |
| 62-148045 | 7/1987 | Japan . |
| 4-89148 | 3/1992 | Japan . |
| 5-261461 | 3/1992 | Japan . |
| 5-195060 | 8/1993 | Japan . |
| 6-23458 | 2/1994 | Japan . |
| 6-087048 | 3/1994 | Japan . |
| 07227635 | 8/1995 | Japan . |
| 07236931 | 9/1995 | Japan . |
| 9-85377 | 9/1995 | Japan . |
| 7-115101 | 12/1995 | Japan . |
| 08010885 | 1/1996 | Japan . |
| 08108238 | 4/1996 | Japan . |
| 10058076 | 3/1998 | Japan . |
| 2 063 123 | 6/1981 | United Kingdom . |

OTHER PUBLICATIONS

Handbuch Federn, Verlag Technik Berlin, 1988, pp. 60–61, Fig. 3.2.

Bihler–transfer, Oct. 1994, Otto Bihler Maschinenfabrik BmbH u. Co., KG, pp. 108.

German Trade journal m+w, 100 Jahre VDW, May 1991, pp. 86, 88.

Japanese Office Action dated May 7, 1999 of basic Japanese Patent Application No. 10–235962.

Japanese Office Action dated Aug. 2, 1999 of basic Japanese Patent Application No. 10–235962.

*Primary Examiner*—Rodney A. Butler

*Attorney, Agent, or Firm*—Merchant & Gould P.C.

[57] ABSTRACT

Plural types of tools are mounted on the tool selection table 210 so as to be selectable by rotation of the tool selection table 210. The tool selection table 210 is made movable by numerical control in the X, Y and Z directions, by virtue of the front-to-back table 206 movable in the front-to-back direction which is parallel to wire axis line L1, horizontal table 203 movable in the horizontal direction which is parallel to the front-to-back direction, and up-and-down table 209 movable in the up-and-down direction which is perpendicular to the front-to-back and horizontal directions.

17 Claims, 26 Drawing Sheets

U.S. PATENT DOCUMENTS 4,302,959 12/1981 Yakovlev et al. .
4,393,678 7/1983 Favol et al. .
4,424,695 1/1984 Kirchhoff et al. .
4,476,702 10/1984 Zangerle .
4,503,694 3/1985 Takumi ..... 72/131
4,586,357 5/1986 Allweier et al. .
4,779,438 10/1988 Frei .
4,825,678 5/1989 Post .
4,873,854 10/1989 Russell et al. .
4,934,165 6/1990 Philpot et al. .
4,947,670 8/1990 Wu .
5,127,247 7/1992 Baisch .
5,259,226 11/1993 Itaya .
5,285,669 2/1994 Itaya .
5,363,681 11/1994 Speck et al. .
5,452,598 9/1995 Cheng .
5,732,583 3/1998 Itaya .
5,839,312 11/1998 Itaya .
5,875,666 3/1999 Itaya .
5,887,471 3/1999 Itaya .
6,000,265 12/1999 Itaya .
6,006,572 12/1999 Tsuritani ..... 72/135

SPRING MANUFACTURING APPARATUS AND TOOL SELECTION APPARATUS

BACKGROUND OF THE INVENTION

The present invention relates to a spring manufacturing apparatus and tool selection apparatus, and more particularly, to a spring manufacturing apparatus and tool selection apparatus for manufacturing various shapes of springs by forcefully bending, winding, or coiling a wire with a tool while continuously feeding the wire to be formed into a spring.

For instance, Japanese Patent Application Laid-Open No. 9-85377 discloses a configuration of providing plural types of tools at the end portion of a tool axis which is arranged opposite to a wire to be formed into a spring and is made movable along a plane orthogonal to the wire axis line.

However, according to the conventional spring manufacturing apparatus, since various tools are concentrated at the end portion of the tool axis, the end shape of the tool axis is complicated. In addition, special processing is necessary to produce a tool shape which corresponds to the motion of the tool axis, thus requiring a high cost. Moreover, since the tool axis is moved vertically and rotated on an axis at the time of tool selection, the motion of tool axis is complicated. The same problem occurs when the fine and small adjustment of the tool positioning is performed by the tool axis. Furthermore, in order to prevent a wire being formed from interfering with other tools which are not involved in wire forming, complicated control needs to be performed. Moreover, when a tool is exchanged, tools which are not necessary to be changed must be removed, which is a cumbersome operation.

As shown in FIGS. 25 and 26, a tool slide 10 is arranged radially in a spring manufacturing apparatus main body. An abutting tool T is slid in the X-axis direction by a cam 10*a*, and the amount of movement in the X-axis direction is numerically controllable.

However, i) fine and small adjustment of tool positioning in the Y-axis direction and Z-axis direction, ii) laying out tool slides in the apparatus main body, and iii) changing the movement and angle of a tool slide are still manually performed. For i) and ii), intuition and experience of an expert are required; thus it is difficult to replicate, and is a time consuming work. For iii), an extremely hard labor is required if the apparatus is large.

SUMMARY OF THE INVENTION

The present invention is made in consideration of the above situation, and has as its object to provide a spring manufacturing apparatus which can selectably attach plural types of tools and which can realize fully automated tool driving and fine and small adjustment of tool positioning by numerical control.

To solve the above-described problems and attain the foregoing object, the spring manufacturing apparatus according to the present invention has the following configuration.

More specifically, the present invention provides a spring manufacturing apparatus for manufacturing a spring by feeding a wire, to be formed into a spring, from an end portion of a wire guide, and forcefully bending, winding, or coiling the wire by tools in a spring forming space near the end of the wire guide, characterized by comprising: wire feed means for feeding the wire toward the spring forming space; a tool selection table, on which the plural tools are radially mounted, rotatable on an axis substantially parallel to a wire axis line so as to enable selection of a predetermined tool from the plural tools; selection table driving means for rotating the tool selection table; a moving table for moving the tool selection table in three-dimensional directions for positioning the selected tool at a predetermined position of the spring forming space; moving table driving means for moving the moving table; and control means for controlling the selection table driving means and the moving table driving means in accordance with a forming procedure of the spring.

Furthermore, the tool selection apparatus according to the present invention has the following configuration.

More specifically, the present invention provides a tool selection apparatus embodied in a spring manufacturing apparatus which manufactures a spring by feeding a wire, to be formed into a spring, from an end portion of a wire guide, and forcefully bending, winding, or coiling the wire by tools in a spring forming space near the end of the wire guide, characterized by comprising: a tool selection table, on which the plural tools are radially mounted, rotatable on an axis substantially parallel to a wire axis line so as to enable selection of a predetermined tool from the plural tools; selection table driving means for rotating the tool selection table; a moving table for moving the tool selection table in three-dimensional directions for positioning the selected tool at a predetermined position of the spring forming space; and moving table driving means for moving the moving table.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follows the description for determining the scope of the invention.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

[Overall Construction of Spring Manufacturing Apparatus According to First Embodiment]

Figure 1:
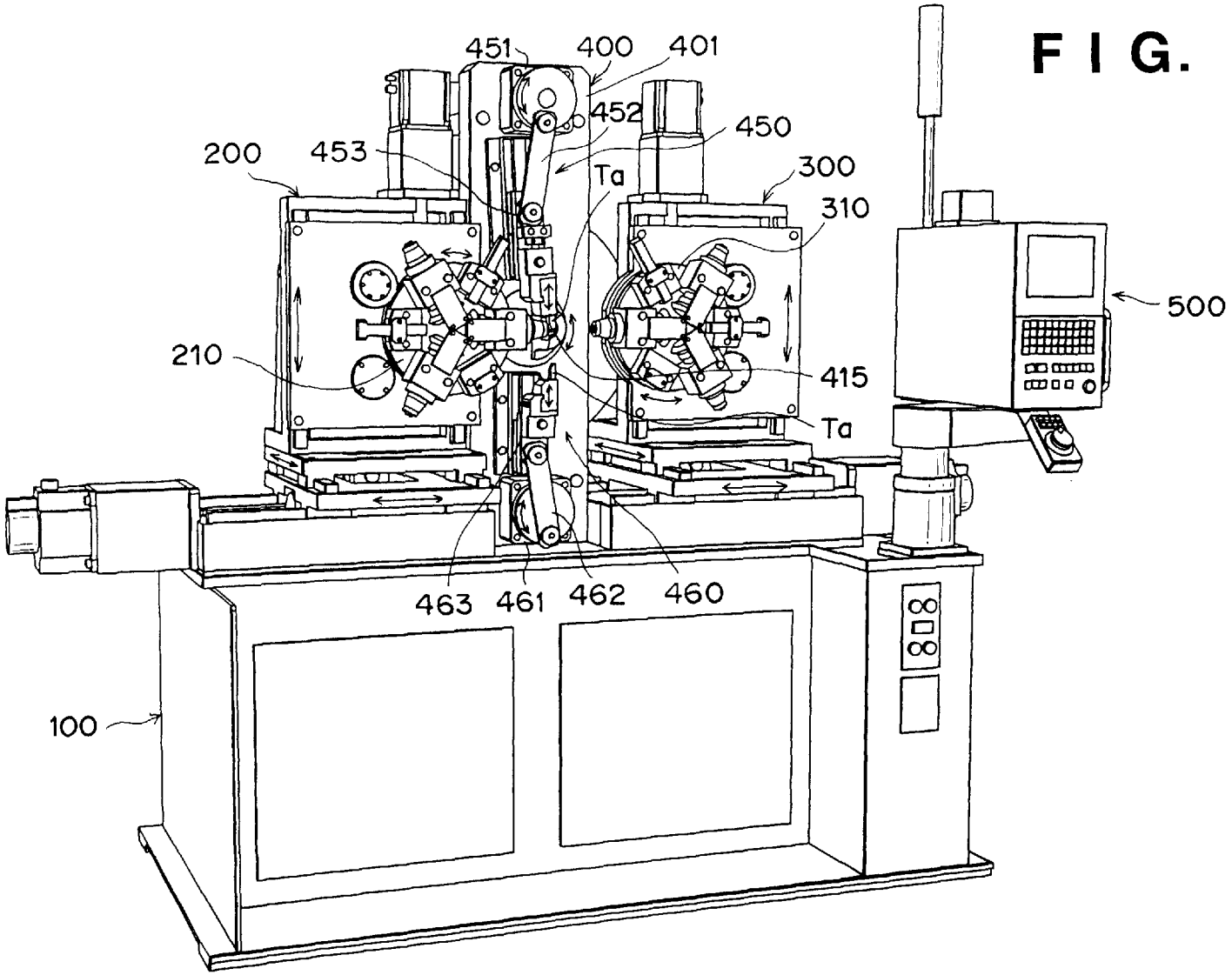
FIG. 1 is a perspective view showing an external appearance of a spring manufacturing apparatus according to a first embodiment of the present invention.
Figure 2:
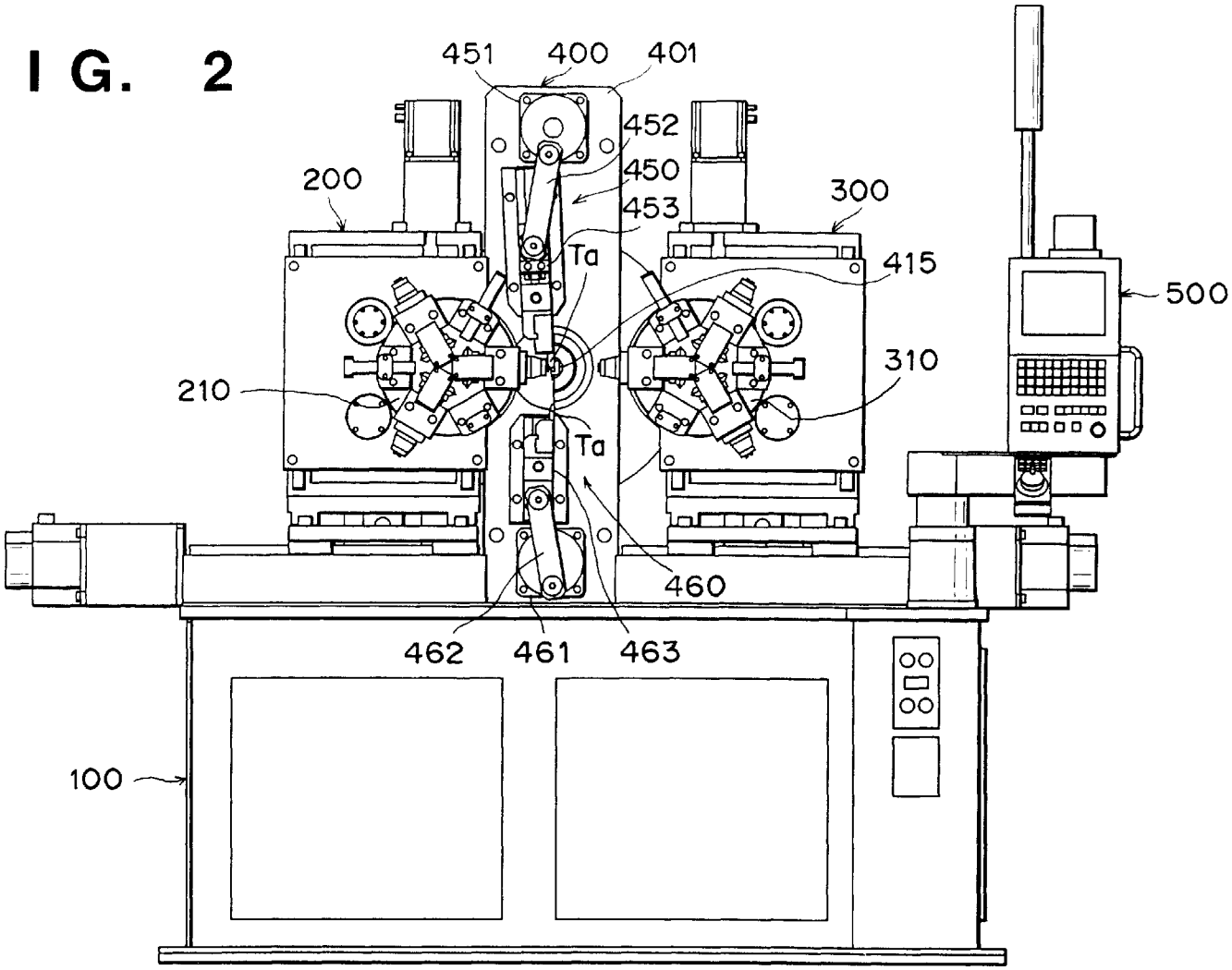
FIG. 2 is a front view of FIG. 1.
Figure 3:
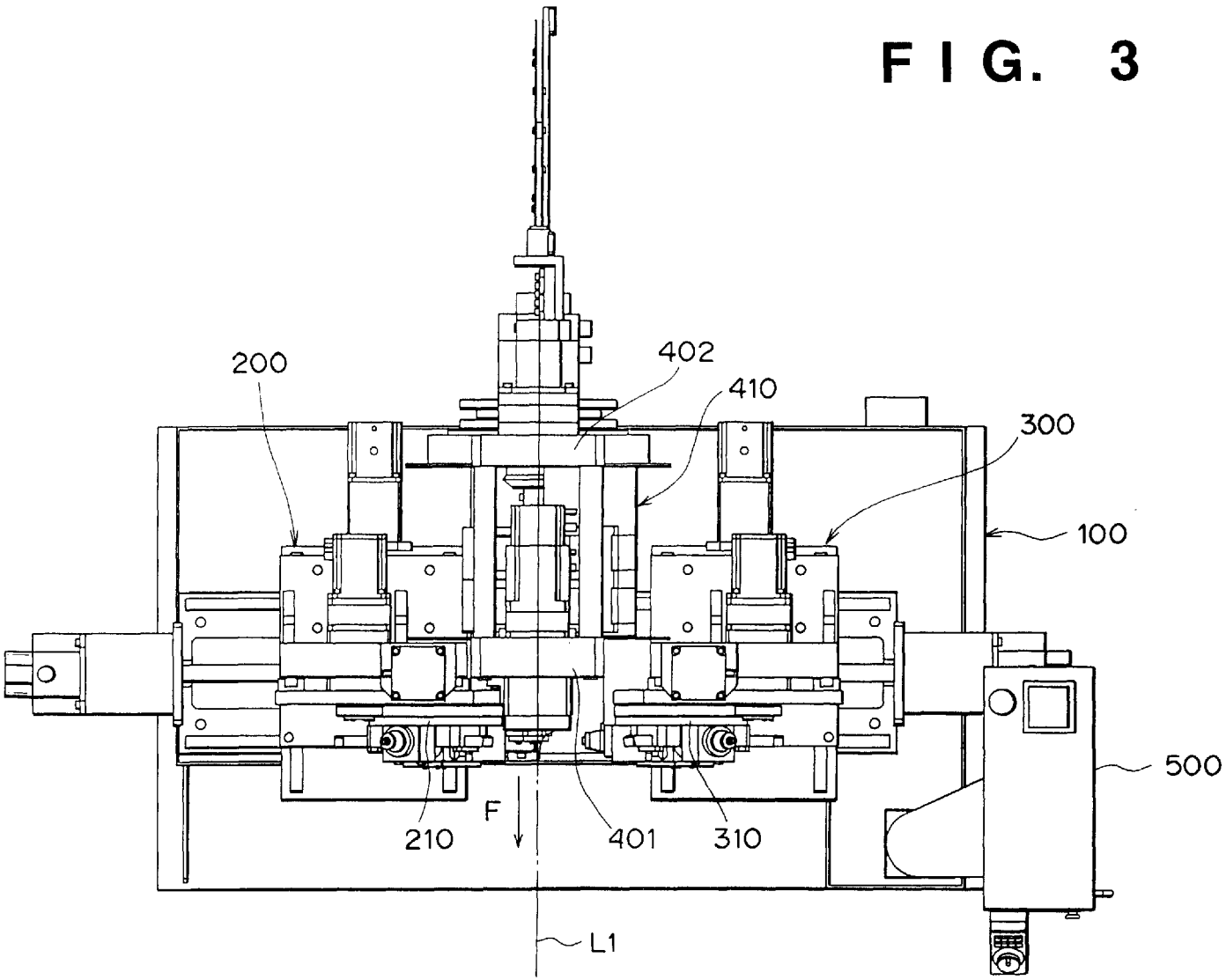
FIG. 3 is a top view of FIG. 1.
Figure 4:
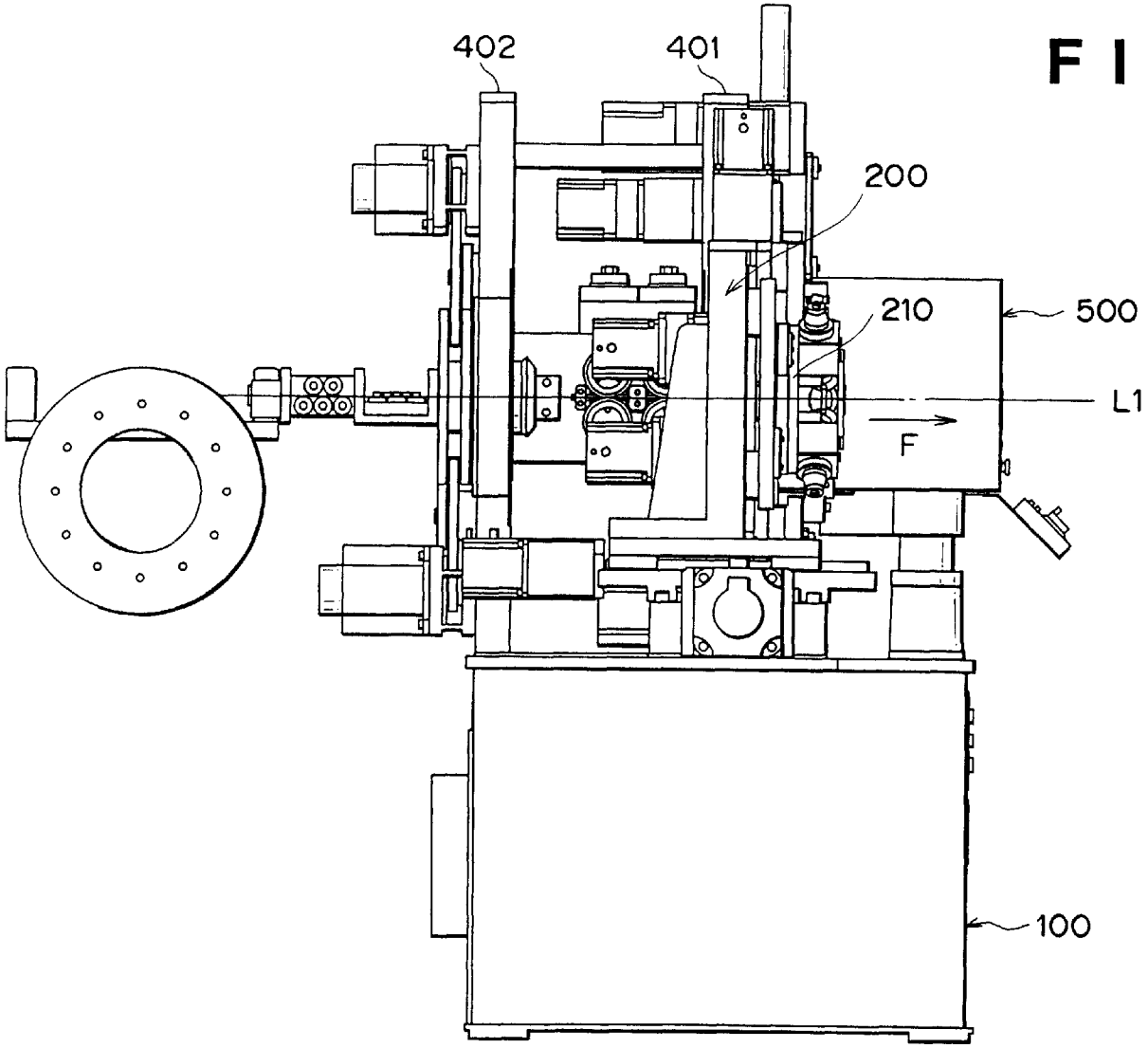
FIG. 4 is a side view of FIG. 1 seen from the left.

FIG. 1 is a perspective view showing an external appearance of a spring manufacturing apparatus according to the first embodiment. FIG. 2 is a front view of FIG. 1. FIG. 3 is a top view of FIG. 1. FIG. 4 is a side view of FIG. 1 seen from the left.

As shown in FIGS. 1 to 4, the spring manufacturing apparatus according to the present embodiment comprises: a rectangular parallelepiped base 100; first tool selection apparatus 200 and second tool selection apparatus 300 arranged on the top surface of the base 100; wire feed apparatus 400 arranged between the first and second tool selection apparatuses 200 and 300; and controller 500 which integrally controls each of the foregoing apparatuses.

The first and second tool selection apparatuses 200 and 300 are arranged symmetrically with respect to the wire feed apparatus 400. First and second tool selection tables 210 and 310, holding plural types of tools, are rotated in the circumferential direction, thereby selecting a desired tool for the spring forming space.

The wire feed apparatus 400 comprises a front frame 401 and a rear frame 402 extended upward from the base 100, and supports a revolving feed mechanism 410 so as to be revolvable around the wire axis line L1. The front frame 401 supports a wire guide 415 so as to be rotatable. The wire guide 415 guides a wire, fed by the wire feed apparatus 400 in the direction of arrow F along the wire axis line L1, to the spring forming space, thereby feeding the wire from the end of the wire guide.

The wire guide 415 is made rotatable without interfering with the tool, to enable forming a spring in a desired shape regardless of the position of the tool. This is realized by altering the space of the inclined surface side of the wire guide 415, thereby changing the spring forming space.

Figure 15A:
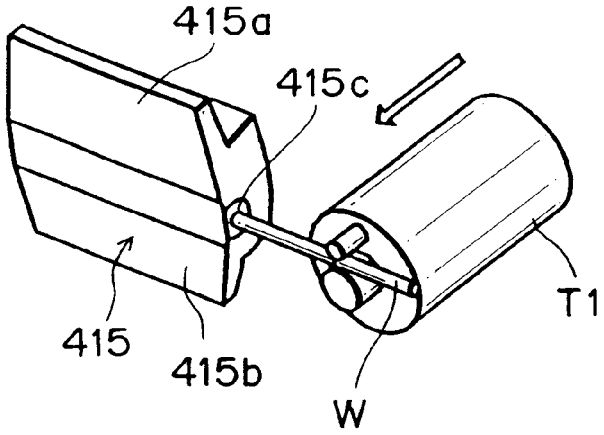
FIGS. 15A and 15B are illustrations showing rotational tool bending in two-dimensional forming.

As shown in FIG. 15A, the wire guide 415 has a symmetrical shape with respect to the wire axis line L1, and has inclined surfaces 415*a* and 415*b* having a predetermined inclination angle, and a wire through hole 415*c* whose cross-section is circular.

The wire guide 415 and a space made by the tool, which has been moved to the working position by the first and second tool selection apparatuses 200 and 300, serve as the spring forming space.

[Auxiliary Tool Apparatus]

As shown in FIGS. 1 and 2, the wire guide 415 is rotatably supported substantially in the center of the front frame 401. Auxiliary tools 450 and 460 are provided respectively above and below the wire guide 415.

The auxiliary tool apparatus 450 provided above the wire guide 415 comprises a tool slider 453 which is slidable in the vertical direction by an auxiliary tool driving motor 451 and crank mechanism 452. On the tool slider 453, an auxiliary tool Ta is mounted.

The auxiliary tool apparatus 460 provided below the wire guide 415 comprises a tool slider 463 which is slidable in the vertical direction by an auxiliary tool driving motor 461 and crank mechanism 462. On the tool slider 463, an auxiliary tool Ta is mounted.

Figure 16A:
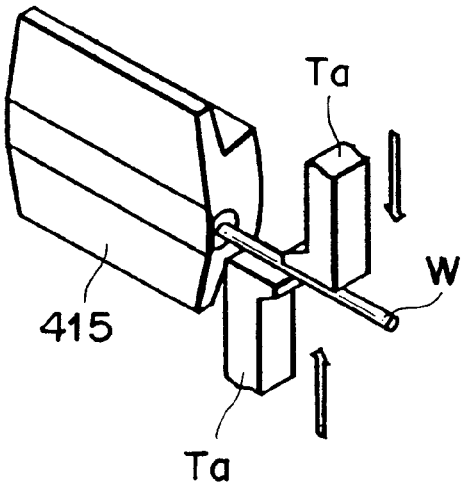
FIGS. 16A and 16B are illustrations showing tool bending in two-dimensional forming.
Figure 16B:
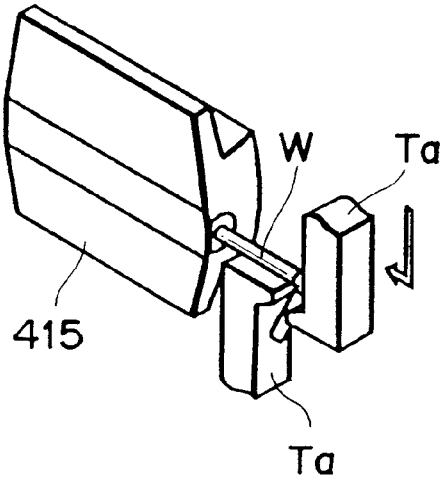
Figure 18A:
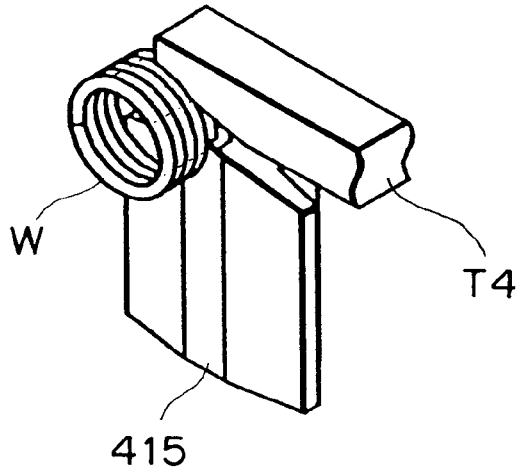
FIGS. 18A and 18B are illustrations showing coiling processing in three-dimensional forming.
Figure 18B:
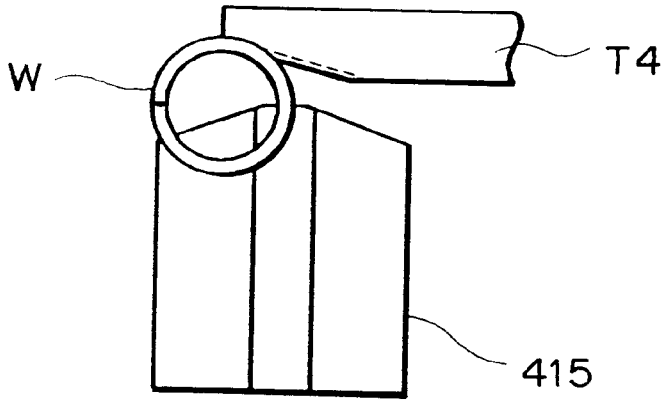
Figure 19A:
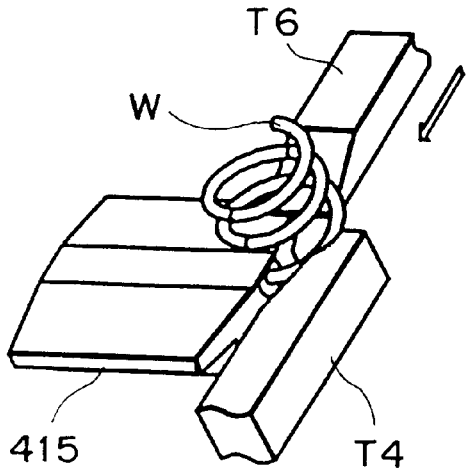
FIGS. 19A and 19B are illustrations showing coiling with a pitch in three-dimensional forming.
Figure 19B:
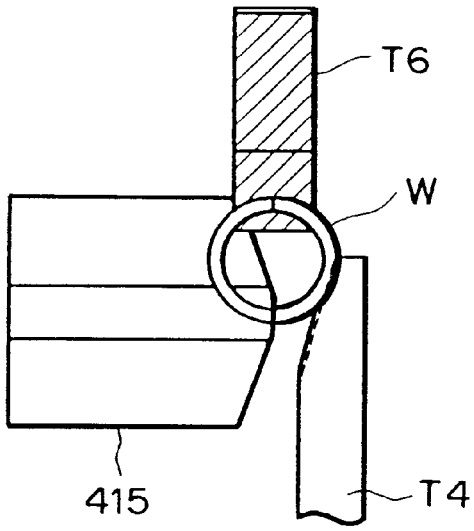
Figure 20A:
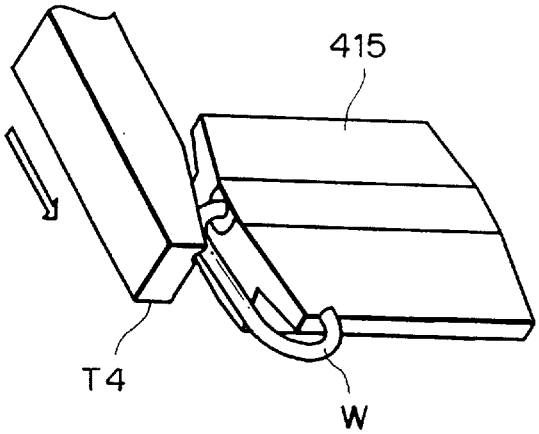
FIGS. 20A to 20C are illustrations showing hook lifting in three-dimensional forming.
Figure 20B:
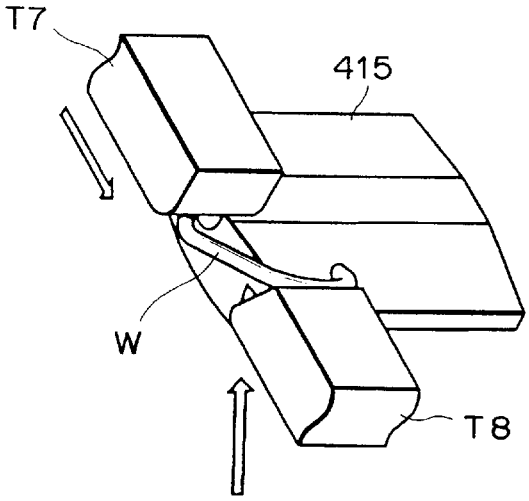
Figure 20C:
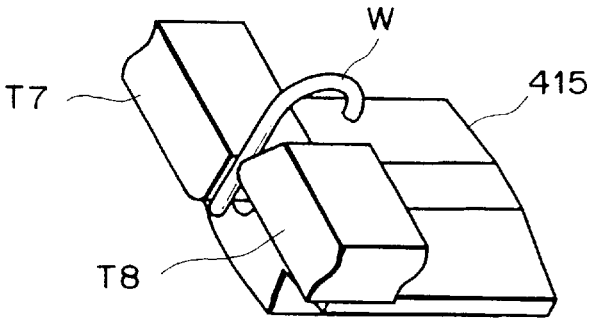
Figure 21A:
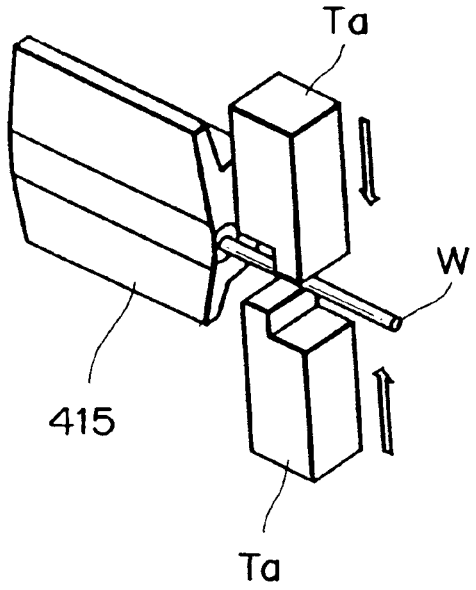
FIGS. 21A and 21B are illustrations showing press forming.
Figure 21B:
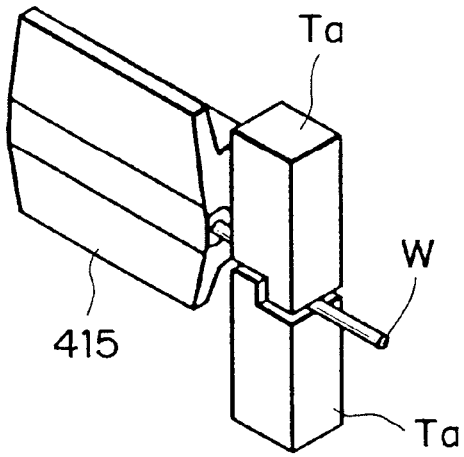
Figure 22A:
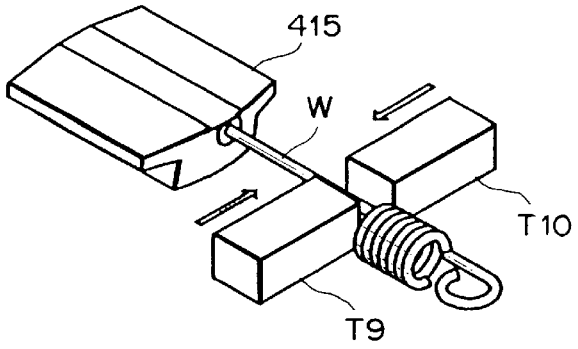
FIGS. 22A to 22D are illustrations showing cutting and tool bending processing after cutting.
Figure 22B:
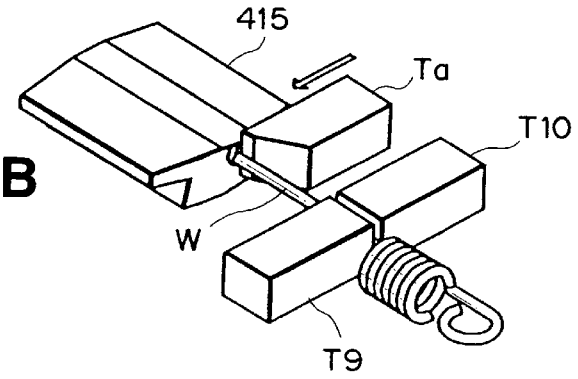
Figure 22C:
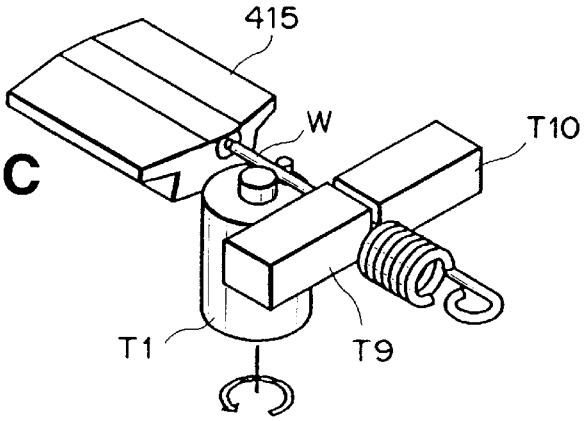
Figure 22D:
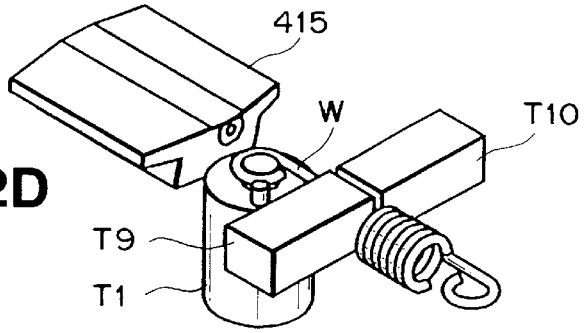

Various tools are provided as the auxiliary tool Ta, for instance, a bending tool as shown in FIGS. 16A and 16B, abutting tool as shown in FIGS. 18A and 18B, pitch tool as shown in FIGS. 19A and 19B, hook lifting tool as shown in FIGS. 20B and 20C, cranking tool as shown in FIGS. 21A and 21B, pressing tool and cutting tool as shown in FIGS. 22A to 22D and so forth.

The most appropriate shape of an auxiliary tool Ta is selectively mounted in accordance with various forming methods which will be described later, and slidably driven toward the spring forming space by numerical control of the auxiliary tool driving motors 451 and 461.

[Tool Selection Apparatus]

Next, the tool selection apparatus embodied in the spring manufacturing apparatus according to the present embodiment is described. Note that since the first and second tool selection apparatuses have a symmetrical configuration, the following description only explains the configuration of the first tool selection apparatus 200.

Figure 5:
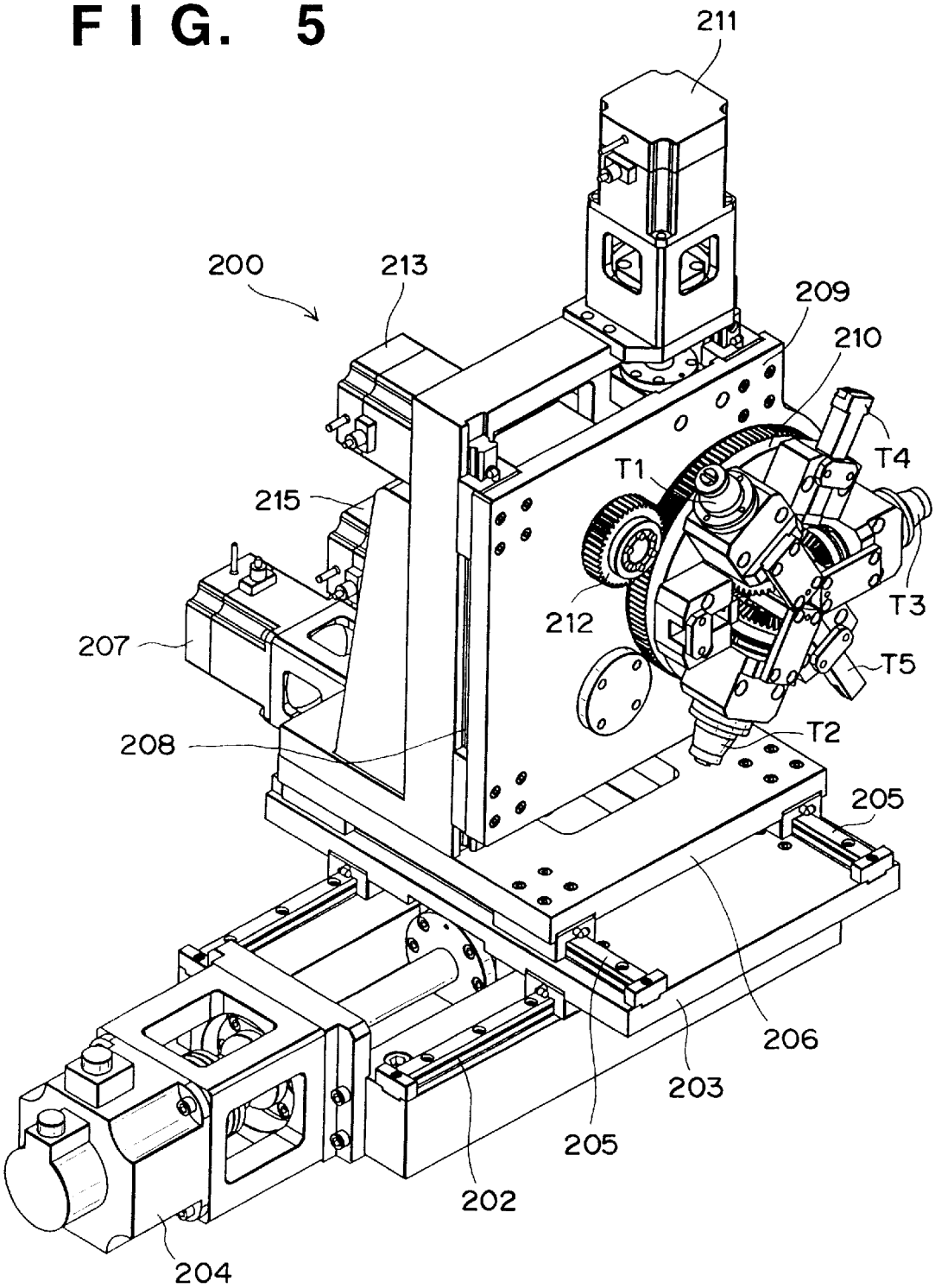
FIG. 5 is a perspective view showing an external appearance of a first tool selection apparatus 200.
Figure 6:
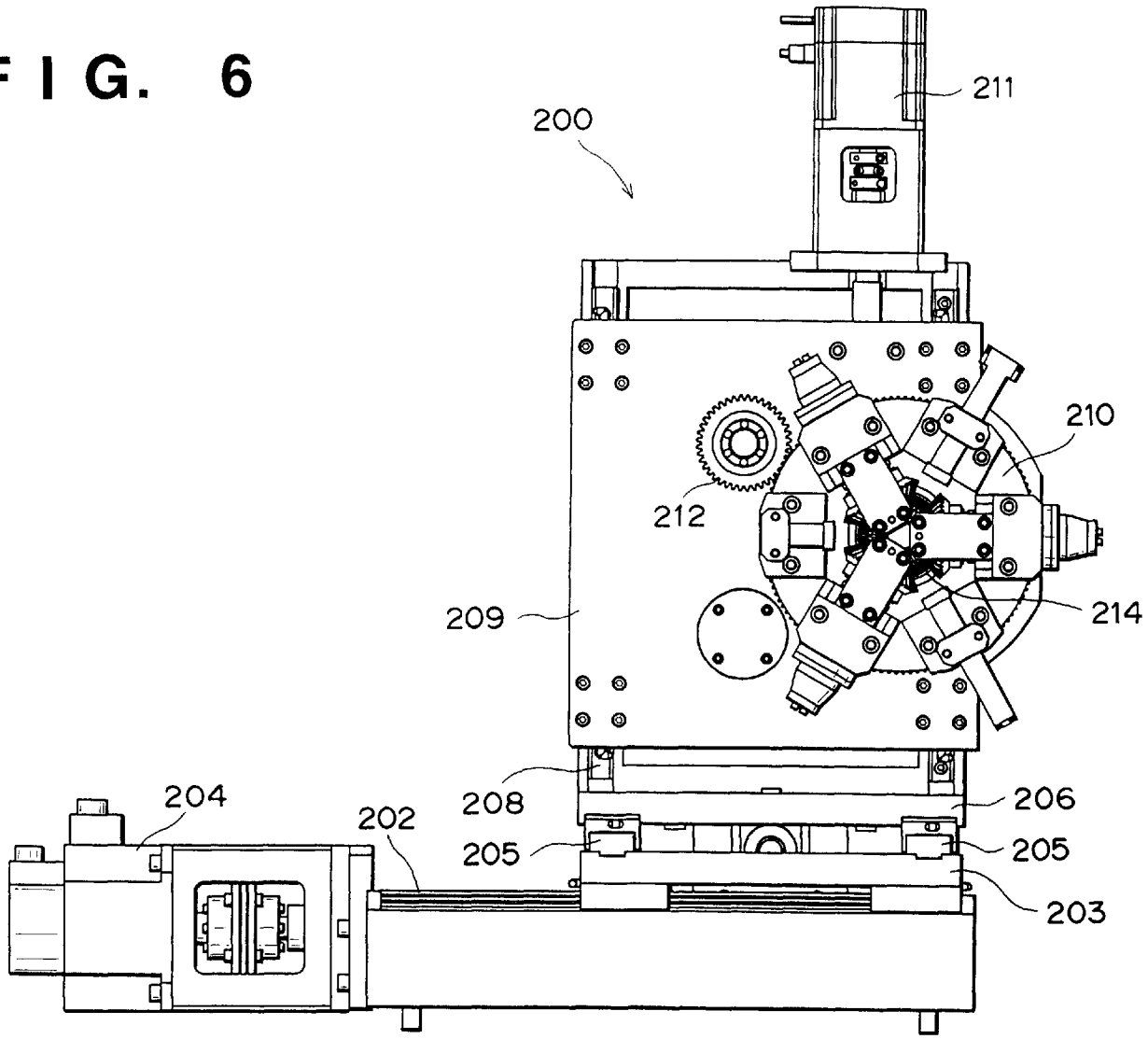
FIG. 6 is a front view of FIG. 5.

FIG. 5 is a perspective view showing an external appearance of the first tool selection apparatus 200. FIG. 6 is a front view of FIG. 5.

As shown in FIGS. 5 and 6, in the first tool selection apparatus 200, the tool selection table 210 is mounted so as to be rotatable on an axis parallel to the wire axis line L1 in the circumference direction. The tool selection table 210 holds plural types of detachable tools having different end shapes and motions (slide or rotate) for various spring sizes, such as the wire diameter or inside diameter of a coil or the like. The disk-like tool selection table 210 is mounted on a moving table, which moves a tool, selected by rotation, toward the spring forming space and three-dimensionally moves the tool selection table 210 for fine and small adjustment of the tool positioning.

The moving table is constructed with a horizontal table 203 which is movable in the horizontal direction along a horizontal rail 202 fixed to the top surface of the base 100; a front-to-back table 206 which is movable in the front-to-back direction along a front-to-back rail 205 fixed to the top surface of the horizontal table 203; and an up-and-down table 209 which is movable in the up-and-down direction along an up-and-down rail 208 extended upward from the top surface of the front-to-back table 206.

The horizontal table 203 is movable along the horizontal rail 202 by a worm screw mechanism or the like, with the use of a horizontal driving motor 204 as a driving source. The front-to-back table 206 is movable along the front-to-back rail 205 by a worm screw mechanism or the like, with the use of a front-to-back driving motor 207 as a driving source. The up-and-down table 209 is movable along the up-and-down rail 208 by a worm screw mechanism or the like, with the use of an up-and-down driving motor 211 as a driving source.

The tool selection table 210, having a tooth profile on its circumferential edge, meshes with a table rotation gear 212 which is driven by a rotation table driving motor 213 attached to the up-and-down table 209, thereby being rotatable on an axis parallel to the wire axis line L1.

On the first tool selection table 210, three types of rotation tools or six types of abutting tools can be mounted. Together with the second tool selection apparatus 300, up to six types of rotation tools or twelve types of abutting tools can be mounted. According to the present embodiment, for instance, three types of rotation tools T1 to T3 and two types of abutting tools T4 and T5 are alternately and radially arranged at equal intervals (only the tool unit is attached to the remaining one), and a desired tool is selected by rotation of the tool selection table 210.

Figure 25:
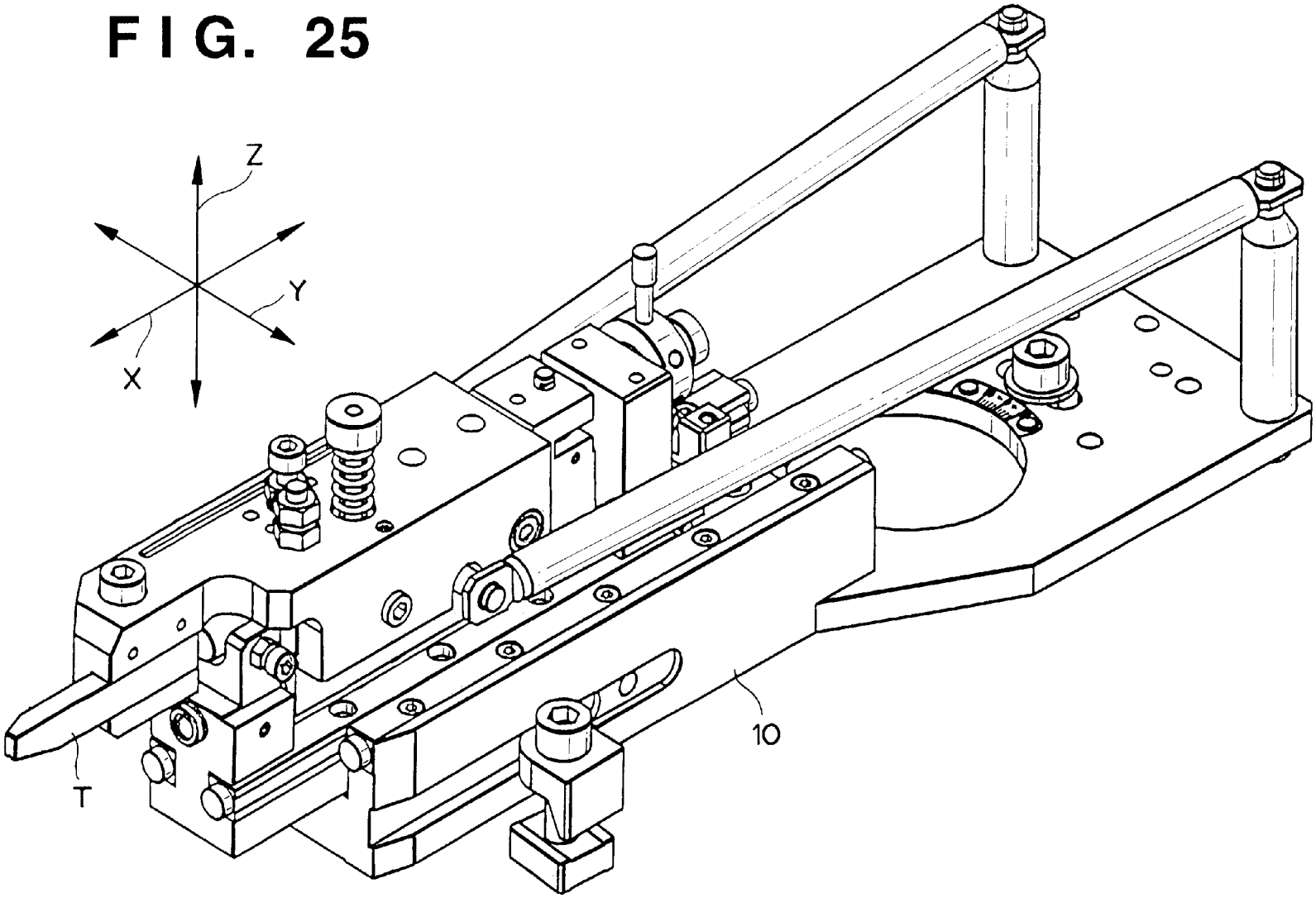
FIG. 25 is a perspective view showing an external appearance of the conventional tool and tool slide.
Figure 26:
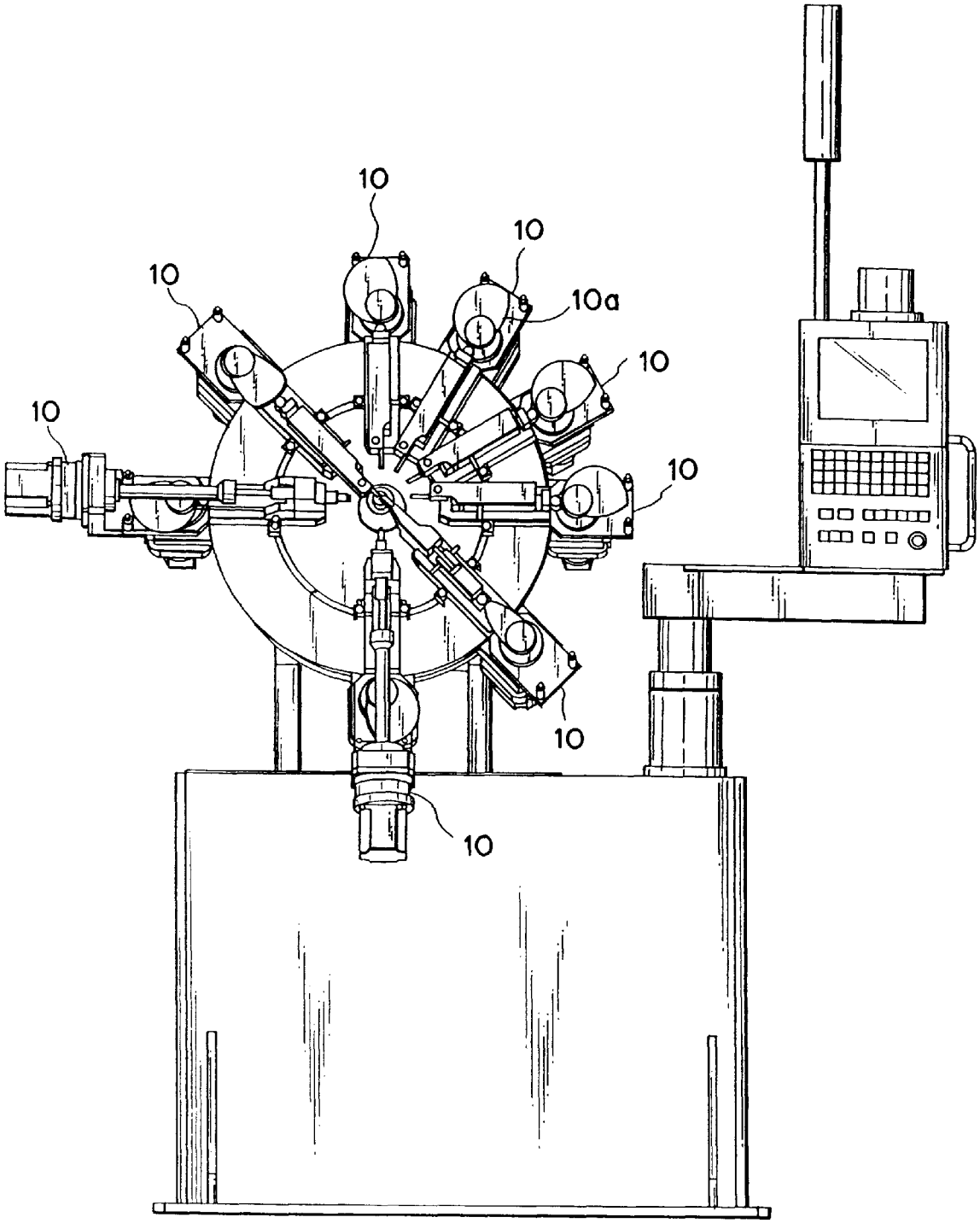
FIG. 26 is a front view of a conventional spring manufacturing apparatus.

Referring to the conventional tool slide shown in FIG. 25, the movement of the horizontal table 203 corresponds to the conventional X-axis direction; the movement of the front-to-back table 206 corresponds to the conventional Z-axis direction; and the movement of the up-and-down table 209 corresponds to the conventional Y-axis direction.

According to the present embodiment, the tool selection table 210 enables selection of the plural types of tools by rotating, and the tool selection table 210 is made movable by numerically controlling the tool selection table in the X, Y and Z directions with the use of the front-to-back table 206 which is movable in the front-to-back direction parallel to the wire axis line L1, the horizontal table 203 which is movable in the horizontal direction perpendicular to the front-to-back direction, and the up-and-down table 209 which is movable in the up-and-down direction perpendicular to the front-to-back and horizontal directions. By this, tool selection, tool driving, and fine and small adjustment of a tool position can be fully automated by numerical control.

[Tool Unit]

Figure 7:
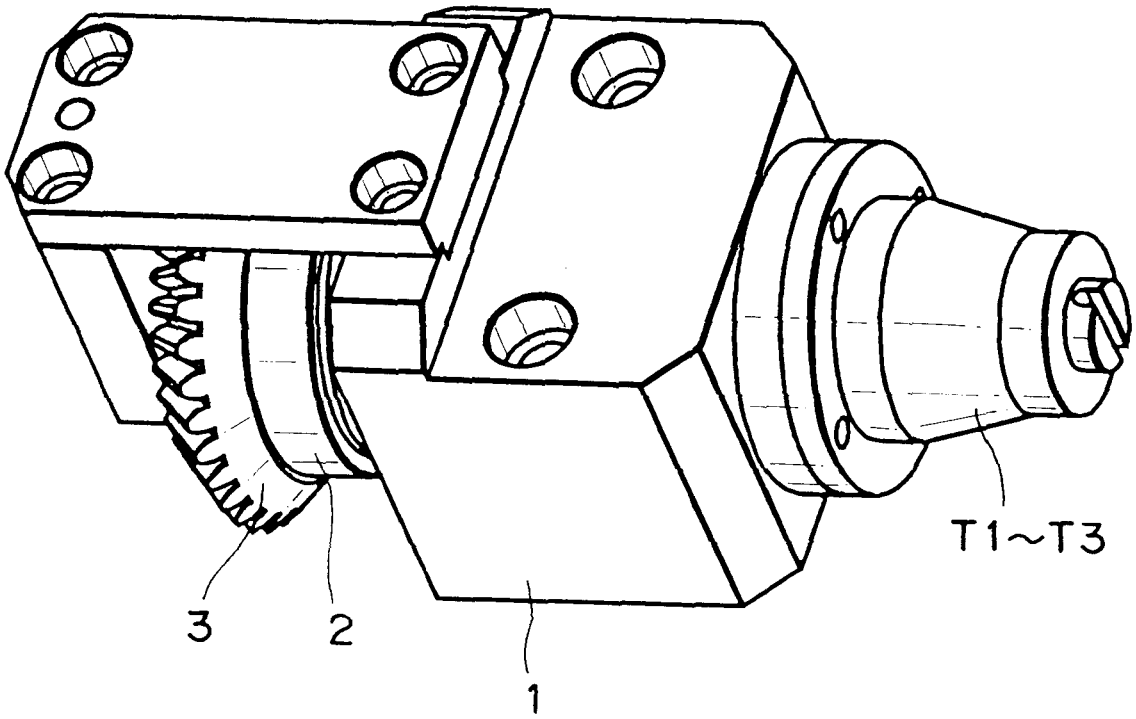
FIG. 7 is an illustration showing an external appearance of a tool unit.
Figure 8:
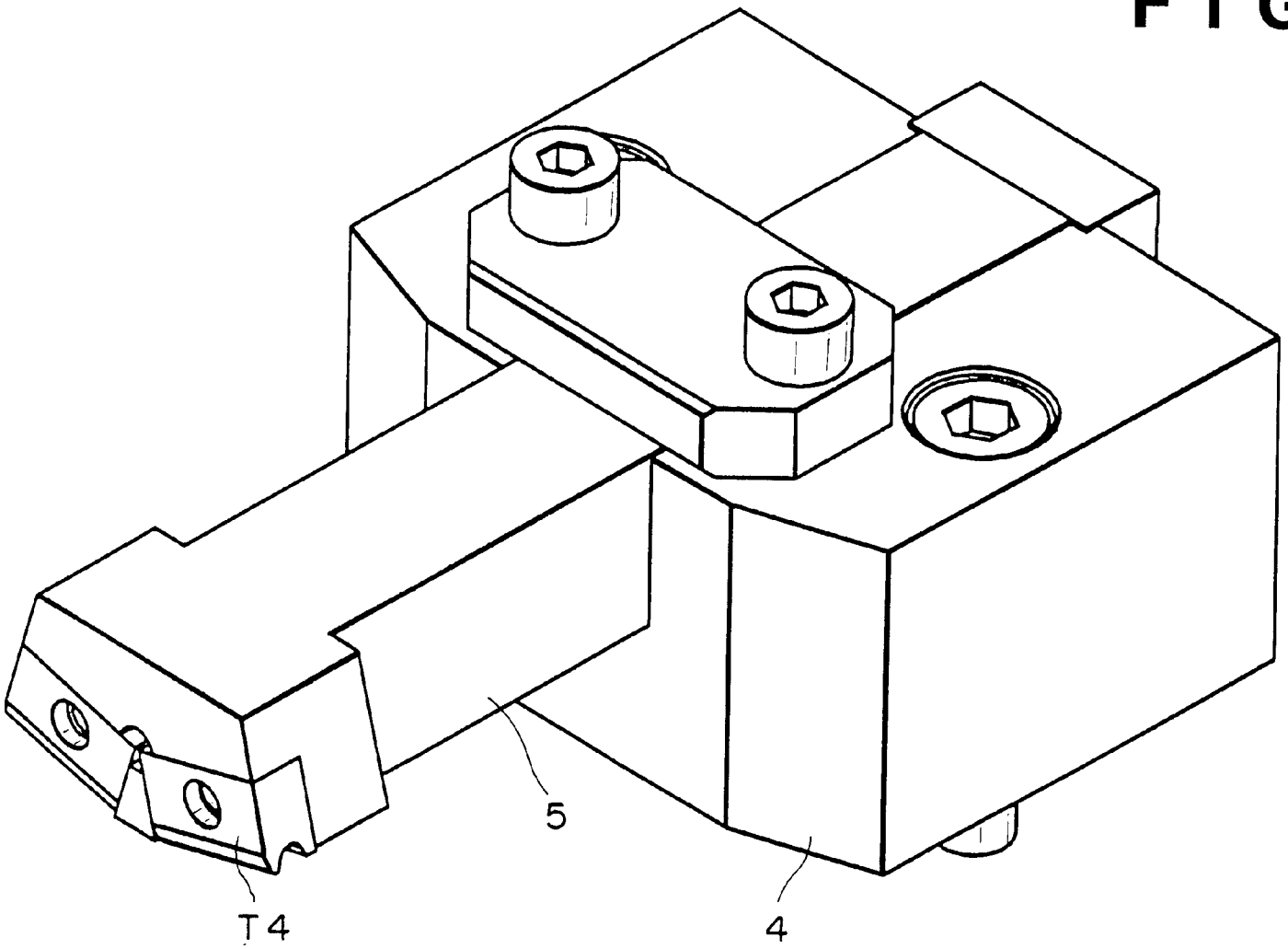
FIG. 8 is an illustration showing an external appearance of a tool unit.
Figure 9:
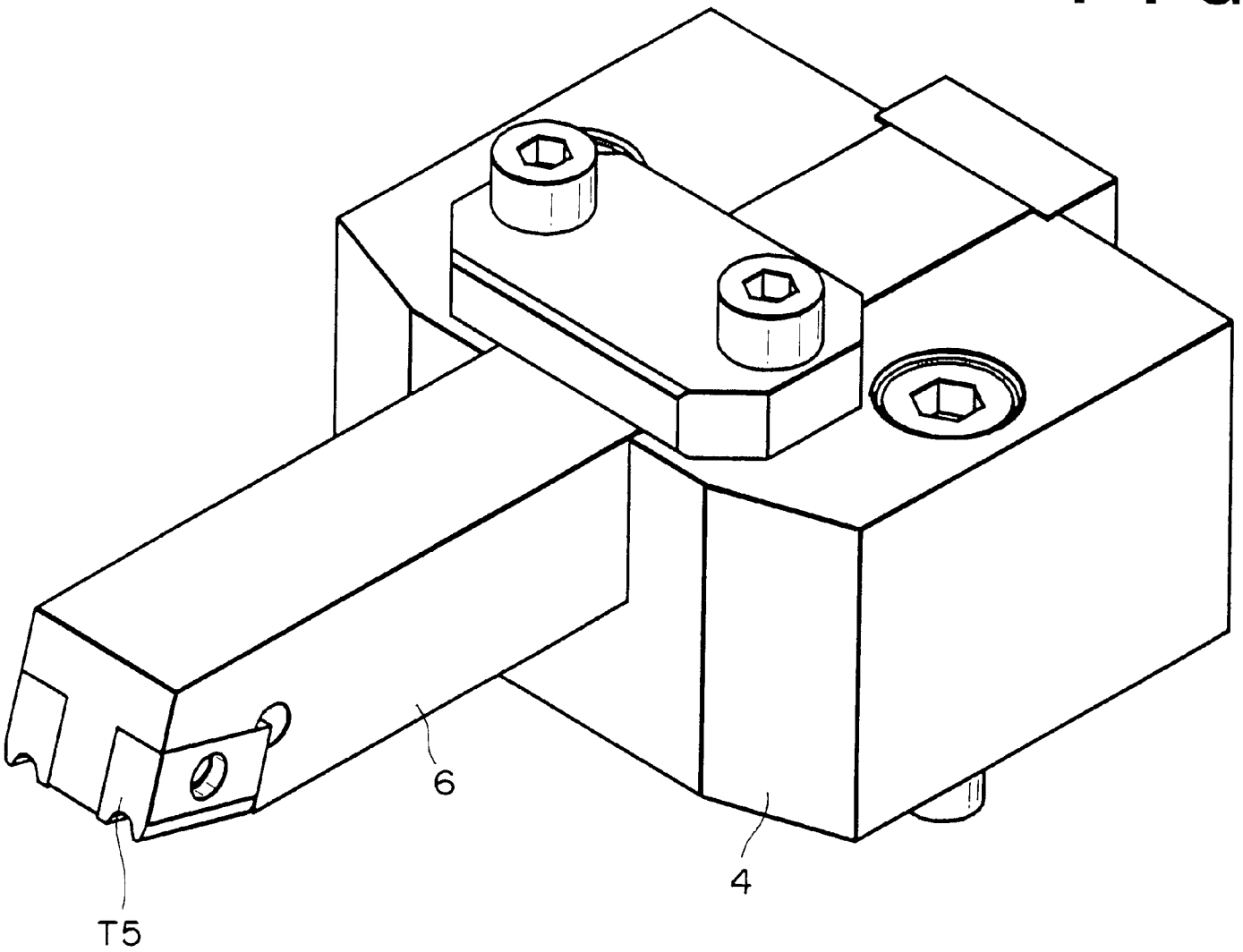
FIG. 9 is an illustration showing an external appearance of a tool unit.

FIGS. 7 to 9 show the external appearance of the tool unit.

As shown in FIG. 7, the rotation tools T1 to T3 which perform bending or coiling processing on a wire are mounted at the end of a tool axis 2. At the other end of the tool axis 2, a bevel gear 3 is attached. The tool axis 2 is rotatably supported by a tool unit 1. While the tool unit 1 is fixed to the tool selection table 210, the bevel gear 3 meshes with a bevel gear 214 (FIG. 6), projected from the center of the tool selection table 210, and is made rotatable regardless of the rotation position of the tool selection table 210. The bevel gear 214 is rotatably supported and uses a tool driving motor 215 (FIG. 5) as a driving source, which is provided on the back surface of the up-and-down table 209.

As shown in FIG. 8, the abutting tool T4 which performs coiling or bending processing by abutting against a wire is attached to the end of a tool axis 5, fixed to a tool unit 4. On the abutting tool T4, a groove is formed orthogonally to the longitudinal direction of the tool axis 5.

As shown in FIG. 9, the abutting tool T5, on which a groove is formed in parallel to the longitudinal direction of a tool axis 6, is attached to the tool unit 4.

Each of these tools T1 to T5 is detachable from the tool selection table 210, and the types or arrangement of the tools may be arbitrarily set.

Furthermore, besides the abutting tool, a bending tool, pressing tool, cutting tool or the like may be attached to the tool unit 4.

[Wire Feed Apparatus]

Figure 10:
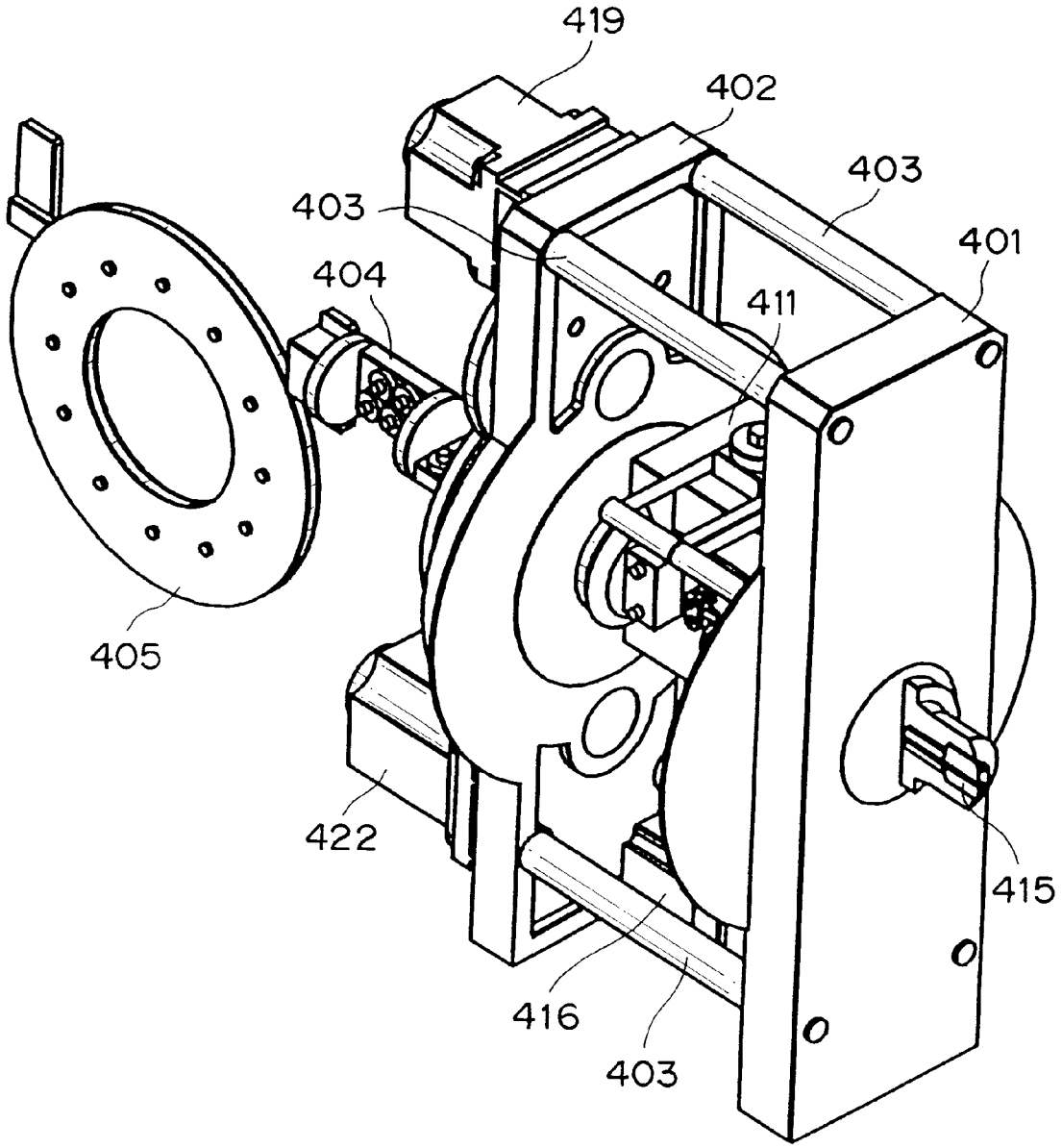
FIG. 10 is a perspective view showing an external appearance of a wire feed apparatus shown in FIG. 1.
Figure 11:
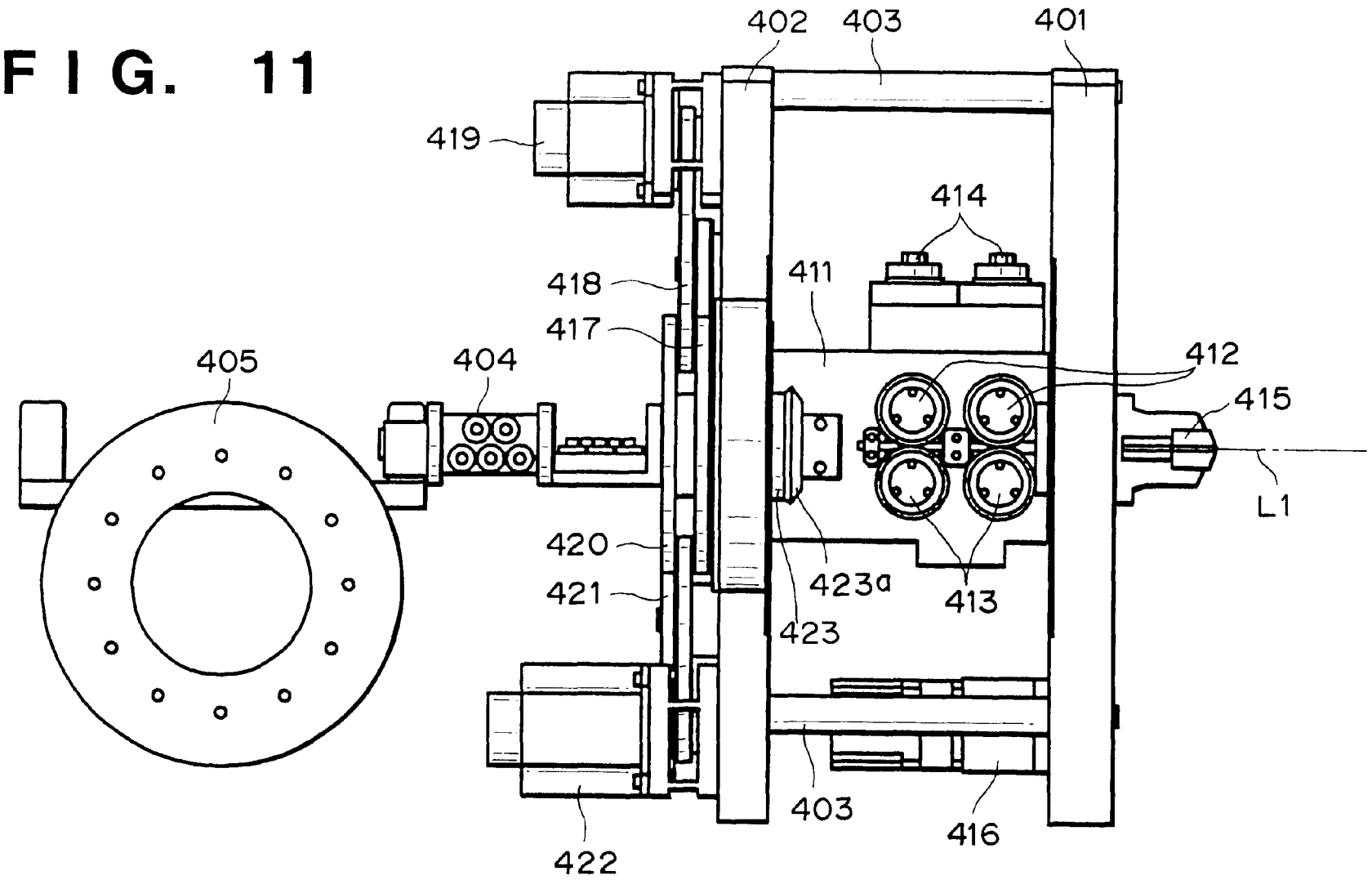
FIG. 11 is a side view of FIG. 10 seen from the left.

FIG. 10 is a perspective view showing an external appearance of the wire feed apparatus shown in FIG. 1. FIG. 11 is a side view of FIG. 10 seen from the left.

As shown in FIGS. 10 and 11, the front frame 401 and rear frame 402 are connected by four connection shafts 403, a pair each provided at the top and bottom. The front frame 401 and rear frame 402 are separated from each other by a predetermined distance in the front and the back, and fixed to the base 100 shown in FIG. 1.

On the back of the rear frame 402, a wire straightening machine 404 for straightening a bend of the wire, and a wire unwinding machine 405 for supplying a wire are sequentially arranged.

The wire feed apparatus 400 comprises a hollow box-like gear box 411, and feed rollers 412 and 413 vertically provided in pairs. The feed rollers 412 and 413 are rotatably provided on the side surface of the gear box 411. The gear box 411 is supported by the front and rear frames 401 and 402 while being revolvable around the wire axis line L1.

The feed rollers 412 and 413 rotate while gripping the wire, thereby feeding the wire forward from the wire unwinding machine 405. The gripping pressure is adjustable by handles 414 provided on the gear box 411. The handles 414 can vertically move the upper feed rollers 412 to adjust the space with the lower feed rollers 413.

The gear box 411 is supported by the front and rear frames 401 and 402 while being revolvable around the wire axis line L1. The gear box 411 revolves while gripping the wire with the feed rollers 412 and 413 so as to twist the wire (rotate about 180° to the left and right), thereby changing the direction of the wire fed from the wire through hole 415*c* of the wire guide 415 (see FIGS. 15A and 15B).

The gear box 411 is fixed to a disk-like gear 417, which has a hollow portion on its rotation axis and is supported by the rear frame 402 while being rotatable on the wire axis line L1. Then, the disk-like gear 417 is meshed with a driving gear 418, and the driving gear 418 is rotated by a gear box rotation motor 419.

The feed rollers 412 and 413 are rotated while allowing the gear box 411 to revolve. Driving force is transmitted to a gear train in the gear box 411 from a bevel gear 423*a*, formed at the end portion of a bevel gear axis 423 which penetrates the rear frame 402 through the hollow portion of the disk-like gear 417. The bevel gear axis 423 rotates on the wire axis line L1, and a disk-like gear 420 fixed at the end portion of the bevel gear axis 423 is meshed with a driving gear 421, and the driving gear 421 is rotated by a roller driving motor 422.

The wire guide 415 is rotatably supported by the front frame 401, and is belt-driven by a guide driving motor 416 independently of the gear box 411.

[Detailed Construction of Gear Box]

Figure 12:
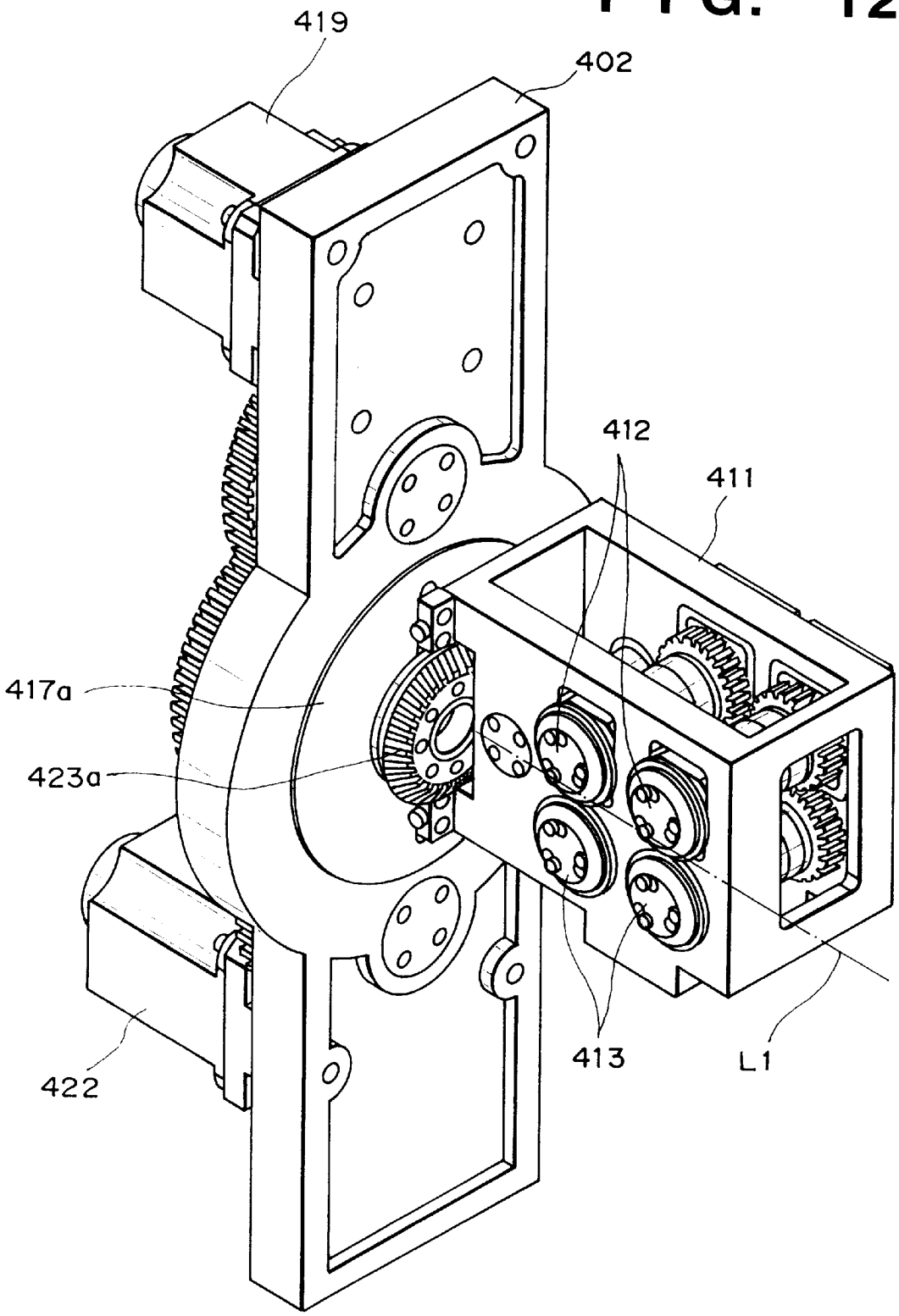
FIG. 12 is a perspective view showing an external appearance of a wire feed apparatus 400, where the front frame 401 is removed.
Figure 13:
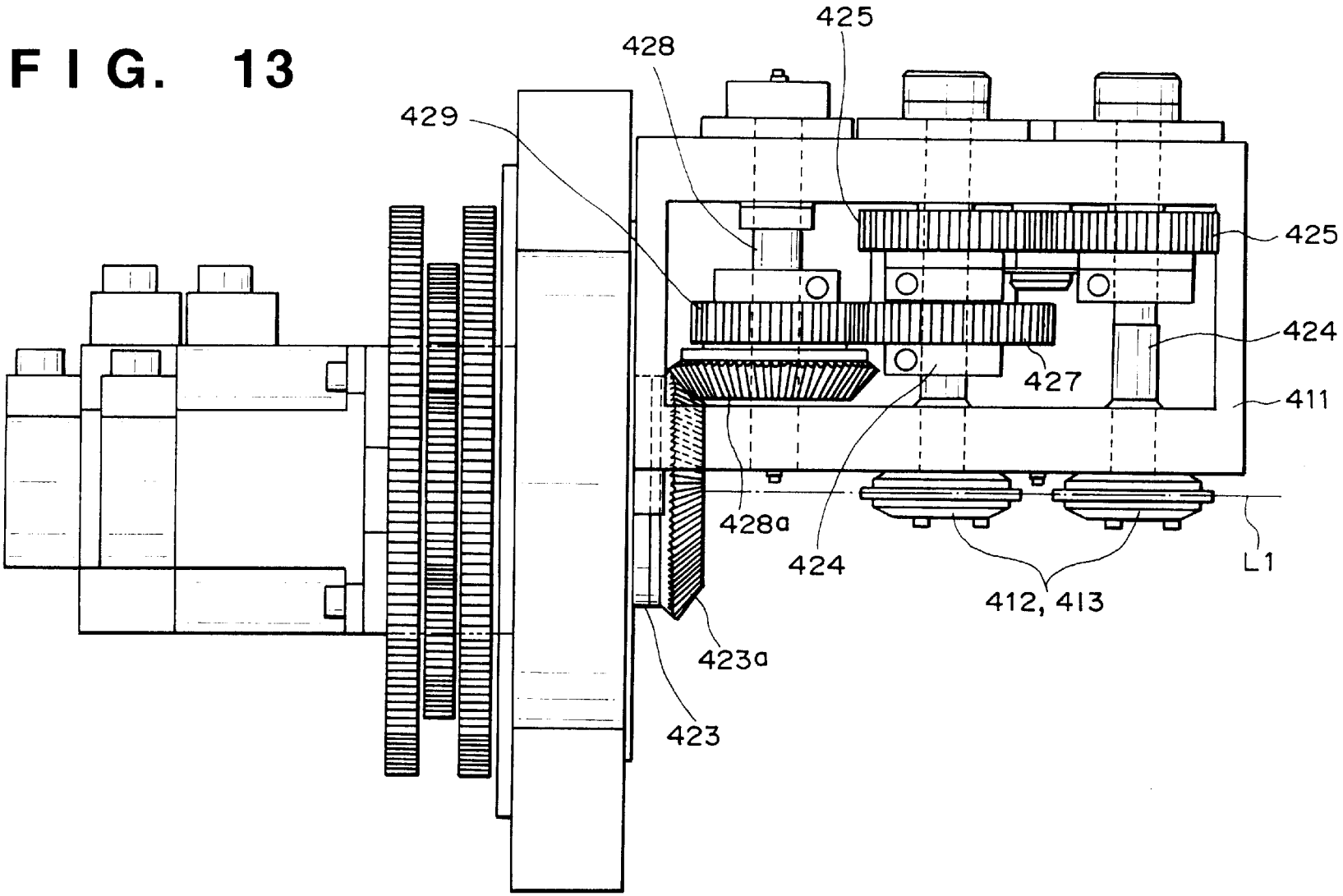
FIG. 13 is a top view of FIG. 12.
Figure 14:
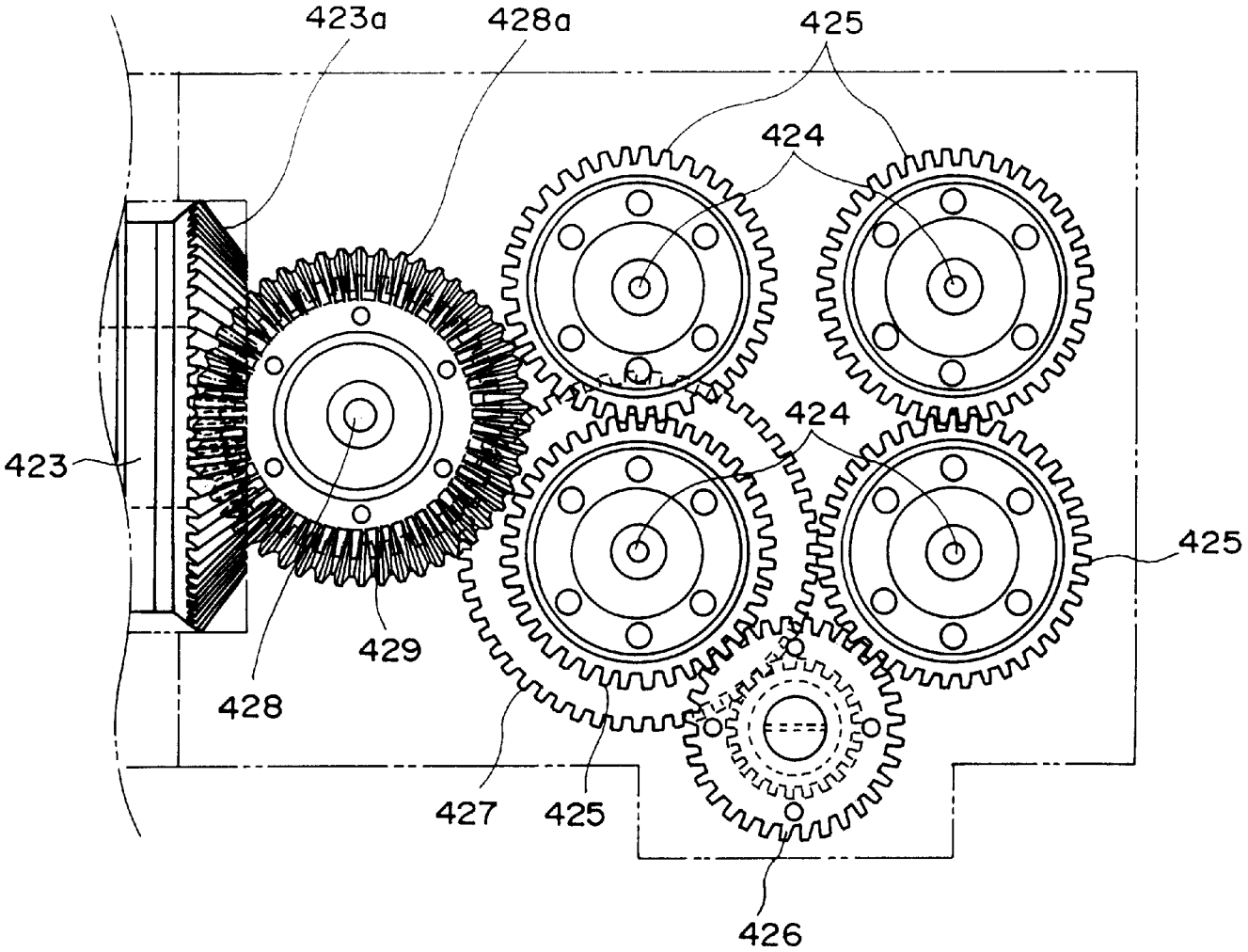
FIG. 14 is a side view of a gear box in FIG. 12 seen from the left.

FIG. 12 is a perspective view showing an external appearance of the wire feed apparatus 400, where the front frame 401 is removed. FIG. 13 is a top view of FIG. 12. FIG. 14 is a side view of the gear box in FIG. 12 seen from the left.

As shown in FIGS. 12 to 14, the gear box 411 is arranged with an offset to the side with respect to the rotation axis (wire axis line L1) of the disk-like gear 417. The gear box 411 is fixed to a rim surface 417*a* of the disk-like gear 417 and revolves around the wire axis line L1. The feed rollers 412 and 413 are connected respectively to four feed roller axes 424 which are provided in the direction perpendicular to the wire axis line L1 and are rotatably supported by the gear box 411. A driving gear 427 is axially fixed to the lower feed roller axis 424 on the rear frame 402 side. Interlocking gears 425 are axially fixed to the feed roller axes 424 which are arranged in parallel to each other. The pair of interlocking gears 425 of the feed roller axes 424 are meshed with each other vertically, and the lower interlocking gears 425 arranged laterally are meshed with an idle gear 426. The driving gear 427 is meshed with the bevel gear 423*a* of the bevel gear axis 423 serving as a main axis, and meshed with a driving gear 429 axially fixed to a bevel gear axis 428 of a bevel gear 428*a* which forms an angle of approximately 90° with the bevel gear axis 423. Then, by rotating the lower feed roller axis 424 on the rear frame side, other feed roller axes 424 are interlockingly rotated via the idle gear 426.

Gears in the gear box 411 are rotatable even while the gear box 411 is revolving.

According to the present embodiment, by rotating the bevel gear axis 423 on the same axis as the wire axis line, the construction of the gear box is simplified, and a bevel gear having a large diameter for transmitting a large driving torque can be used.

Moreover, since a large driving torque can be attained, the necessary wire feeding force can be maintained, and the durability is enhanced even with an inexpensive construction.

Furthermore, since the feed roller axis 424 is rotated by the driving gear 429 axially fixed to the bevel gear axis 428 of the bevel gear 428*a* which meshes with the bevel gear 423*a* and forms an angle of approximately 90° with the bevel gear axis 423, heating problems occurring in worm gears are solved, thus energy loss due to the heat is reduced.

[Wire Forming Method]

Next, description is provided on the wire forming method realized by numerical control of a spring manufacturing apparatus according to the present embodiment.

The wire forming method, the number of tools simultaneously used in each method and forming process are roughly categorized as follows.

| Forming method | Number of tools used simultaneously | Example |
|---|---|---|
| two-dimensional forming | one or more | rotational tool bending, tool bending |
| three-dimensional forming | two or more | rotational tool coiling, coiling, coiling with a pitch, hook lifting |
| press forming | two or more | cranking |
| special forming | three or more | bending after cutting |
| cutting | one or more | cutting products |

Figure 15B:
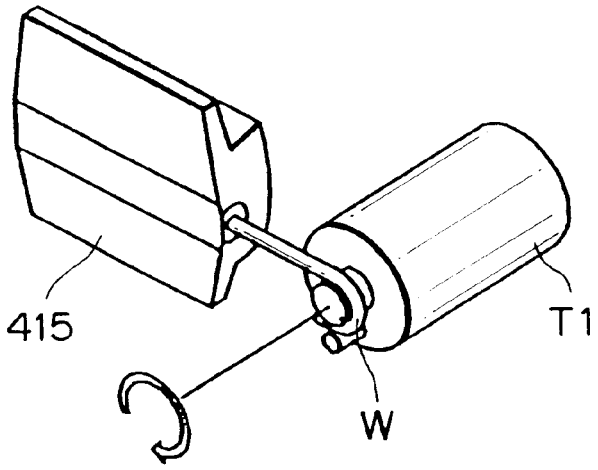

FIGS. 15A and 15B are illustrations showing rotational tool bending in two-dimensional forming.

In a case where rotational tool bending is performed in two-dimensional forming, either the first tool selection apparatus 200 or second tool selection apparatus 300 is selected in accordance with the bending direction of a wire, then a desired rotation tool T1 is selected by rotating the selected tool selection table, and the rotation tool T1 is moved by a moving table to the position shown in FIGS. 15A and 15B. Then, the tool is rotated so that the end portion of the tool bends the wire W, thereby forming a hook of a spring or the like. The rotational tool bending enables to bend a wire without scratching the wire.

Up to three types of rotation tools can be mounted on one tool selection table according to the present embodiment. Therefore, various bending processing can be realized.

FIGS. 16A and 16B are illustrations showing tool bending in two-dimensional forming.

In a case where tool bending is performed in two-dimensional forming, L-shape bending tools Ta are attached to the auxiliary tool apparatuses 450 and 460, and the bending tools Ta arranged face to face with each other are slid vertically in the opposite direction by a crank mechanism, thereby bending the wire W. The tool bending processing is used when there is no space for a rotation tool to enter.

Note that bending processing may be performed by mounting the bending tool on the tool selection table and moving the tool by a moving table.

Figure 17A:
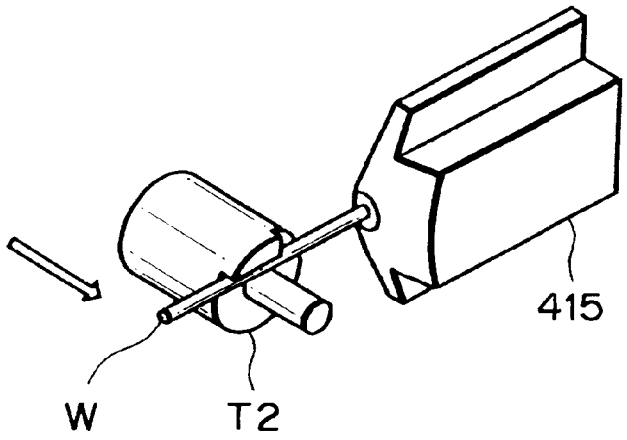
FIGS. 17A and 17B are illustrations showing rotational tool coiling in three-dimensional forming.
Figure 17B:
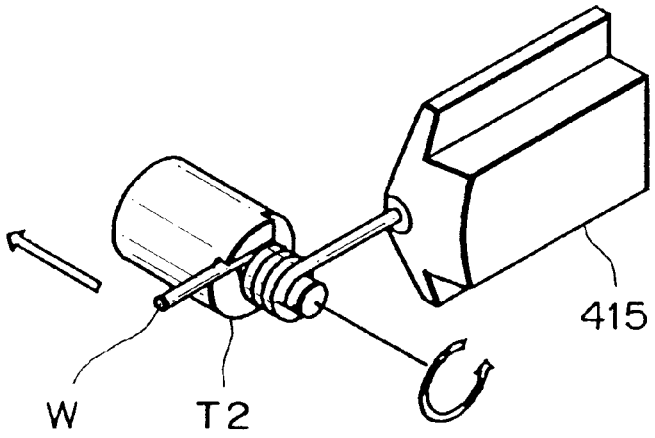

FIGS. 17A and 17B are illustrations showing rotational tool coiling in three-dimensional forming.

In a case where rotational tool coiling is performed in three-dimensional forming, either the first tool selection apparatus 200 or second tool selection apparatus 300 is selected in accordance with the coiling direction of a wire, then a desired rotation tool T2 is selected by rotating the selected tool selection table, and the rotation tool T2 is moved by the moving table to the position shown in FIGS. 17A and 17B. Then, the rotation tool T2 is rotated so that the end portion of the tool coils the wire W, and forms a coil of a spring or the like. The rotational tool coiling enables forming a spring having a small ratio of the coil's outside diameter and wire diameter. Particularly, since the inside diameter of a coil can be precisely manufactured, the rotational tool coiling is effective in forming a clutch spring or the like.

FIGS. 18A and 18B are illustrations showing coiling processing in three-dimensional forming.

In a case where coiling is performed in three-dimensional forming, either the first tool selection apparatus 200 or second tool selection apparatus 300 is selected in accordance with the coiling direction of a wire, then a desired abutting tool T4 is selected by rotating the selected tool selection table, and the abutting tool T4 is moved by the moving table to the position shown in FIGS. 18A and 18B. By extruding the wire W, the wire W is forcefully abutted against the end portion of the abutting tool T4 and coiled on the inclined surface of the wire guide 415. By this, a coil of a spring or the like is formed. In this coiling processing, the outside diameter of a coil can be easily changed by simply moving the moving table, and thus the coiling angle can be easily controlled. Furthermore, by changing the groove position at the end portion of the abutting tool T4, the initial tension and pitch can be readily set.

FIGS. 19A and 19B are illustrations showing coiling with a pitch in three-dimensional forming.

In a case where coiling with a pitch is performed in three-dimensional forming, either the first tool selection apparatus 200 or second tool selection apparatus 300 is selected in accordance with the coiling direction of a wire, then a desired abutting tool T4 is selected by rotating the selected tool selection table, and the abutting tool T4 is moved by the moving table to the position shown in FIGS. 19A and 19B. Furthermore, a desired pitch tool T6 is selected by rotating the other tool selection table and the pitch tool T6 is moved by the moving table to the position shown in FIGS. 19A and 19B. By extruding the wire W, the wire W is forcefully abutted against the end portion of the abutting tool T4 and coiled on the inclined surface of the wire guide 415, while the pitch tool T6 intervenes to form a pitch between coils. By this, a coil of a spring or the like is formed. In this coiling processing with a pitch, the pitch can be readily set while forming a coil.

FIGS. 20A to 20C are illustrations showing hook lifting in three-dimensional forming.

In the hook lifting processing, the hook which has been formed into a two-dimensional shape by the rotation tool or abutting tool is further bent by the hook lifting tools T7 and T8 to be formed into a three-dimensional shape.

In a case where hook lifting is performed in three-dimensional forming, either the first tool selection apparatus 200 or second tool selection apparatus 300 is selected in accordance with the coiling direction of a wire, then a desired abutting tool T4 is selected by rotating the selected tool selection table, and the abutting tool T4 is moved by the moving table to the position shown in FIGS. 20A to 20C. By extruding the wire W, the wire W is forcefully abutted against the end portion of the abutting tool T4 and bent. Then, each tool selection table of the first and second tool selection apparatuses 200 and 300 is rotated to select desired hook lifting tools T7 and T8. While moving each of the tools T7 and T8 by the moving table to the position shown in FIGS. 20B and 20C, the hook portion, which has been formed into a two-dimensional shape, is bent so as to be formed into a three-dimensional shape.

FIGS. 21A and 21B are illustrations showing press forming.

In press forming, the wire W is gripped by cranking tools T9 and T10 arranged opposite to each other, thereby forming the wire W into a crank shape.

In a case where press forming is performed, pressing tools Ta having symmetrical steps are attached to the auxiliary tool apparatuses 450 and 460, and the pressing tools Ta arranged face to face with each other are slid vertically by a crank mechanism, thereby clamping and bending the wire W. Press forming is used for forming a wire into a special shape.

Note that press forming processing may be performed by mounting the cranking tool on the tool selection table and moving the tool by a moving table.

FIGS. 22A to 22D are illustrations showing cutting and tool bending processing after cutting.

In a case where cutting processing is performed, a cutting tool Ta is attached to either the auxiliary tool apparatus 450 or 460, then respective tool selection tables of the first and second tool selection apparatuses 200 and 300 are rotated to select pressing tools T9 and T10, and the pressing tools T9 and T10 are moved by the moving table to the position shown in FIGS. 22A to 22D. While the pressing tools T9 and T10, arranged face to face with each other, grip the wire W, the cutting tool Ta is slid to cut the wire W.

Furthermore, in a case of bending the cut portion of the wire, bending processing is performed by the steps described with reference to FIGS. 15A and 15B by using the rotation tool T1.

[Construction of Controller]

Next, the construction of a controller of the spring manufacturing apparatus according to the present embodiment is described.

Figure 23:
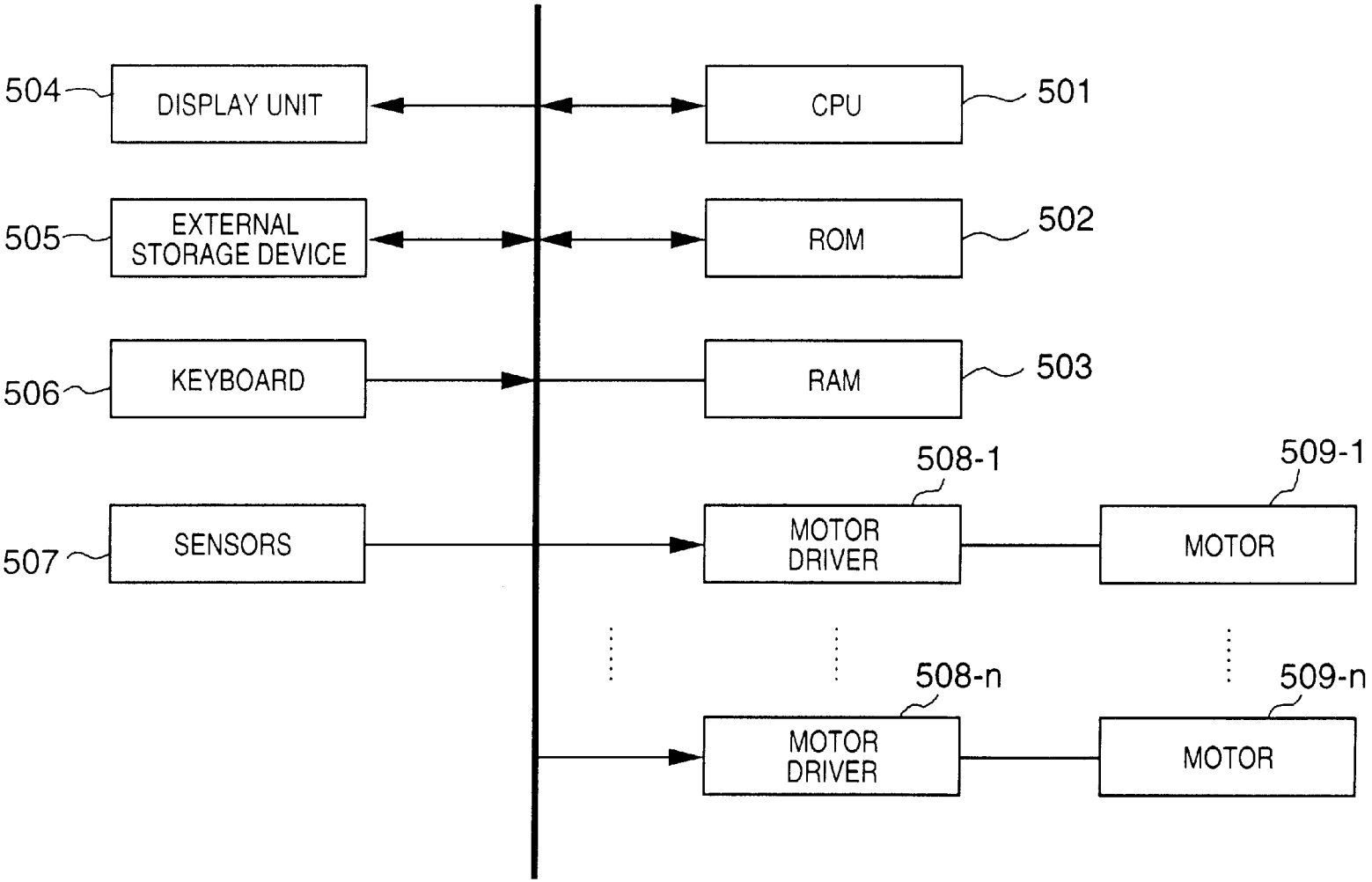
FIG. 23 is a block diagram showing a construction of a controller 500 of a spring manufacturing apparatus.

FIG. 23 is a block diagram showing a construction of a controller 500 of the spring manufacturing apparatus.

As shown in FIG. 23, a CPU 501 integrally controls the entire controller 500. A ROM 502 stores operation processing contents (program) of the CPU 501 and various font data. A RAM 503 is used as a work area of the CPU 501. A display unit 504 is used for performing various setting, displaying contents of various setting, and displaying a graph showing manufacturing progress or the like. An external storage device 505 is a floppy disk drive or the like, and is used for externally supplying a program or storing various setting contents for forming processing. By storing parameters for a forming processing (e.g., in a case of a spring, a free length or diameter or the like), it is possible to manufacture at any time the same shape of a spring by setting the floppy disk.

A keyboard 506 is provided for setting various parameters. Sensors 507 are provided for sensing the wire feeding amount or free length of a spring or the like.

Motors 508-1 to 508-n respectively denote the horizontal driving motor 204, front-to-back driving motor 207, up-and-down driving motor 211, rotation table driving motor 213, tool driving motor 215, each motor of the second tool selection apparatus, wire guide driving motor 416, gear box rotation motor 419, roller driving motor 422, and auxiliary tool driving motors 451 and 461. The motors 508-1 to 508-n are driven by the respective motor drivers 509-1 to 509-n.

In a case of selecting a desired tool from plural types of tools and fine and small adjustment of the tool position, the first tool selection table 210 is rotated by the rotation table driving motor 213, a desired tool is positioned in the spring forming space, and the horizontal table 203, front-to-back table 206, and up-and-down table 209 are moved for fine and small adjustment of the positioning. Then, tool operation is numerically controlled in accordance with the spring forming method.

As has been described above, plural types of tools are selectably attached, and tool driving and fine and small adjustment of the tool position can be fully automated by numerical control.

In the above control block, the CPU 501 controls, for instance, to drive various motors independently, or controls input/output of the external storage device 505 or the display unit 504 according to the instruction inputted by the keyboard 606.

[Overall Construction of Spring Manufacturing Apparatus According to Second Embodiment]

Figure 24:
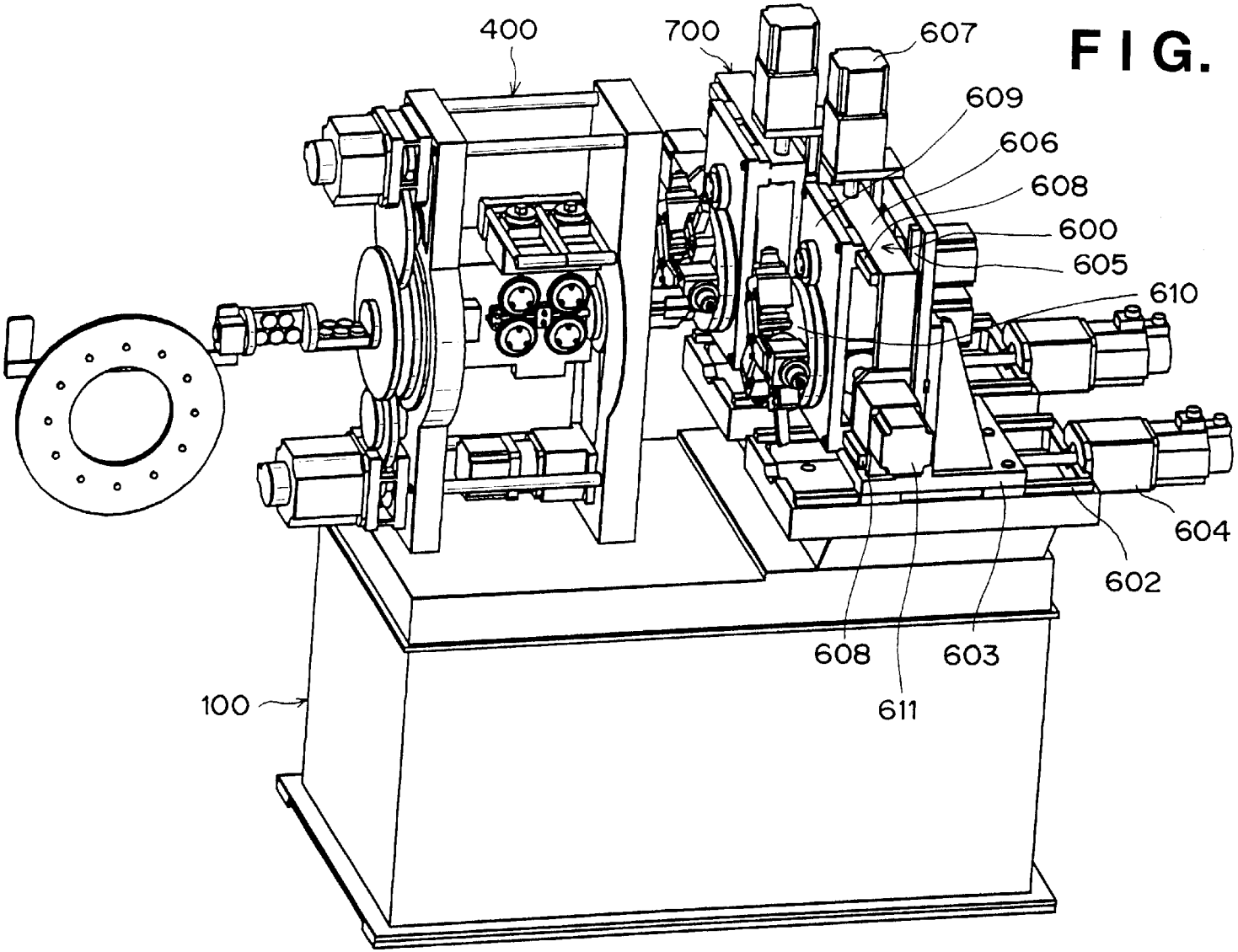
FIG. 24 is a perspective view showing an external appearance of a spring manufacturing apparatus according to a second embodiment of the present invention.

FIG. 24 is a perspective view showing an external appearance of a spring manufacturing apparatus according to the second embodiment.

As shown in FIG. 24, according to the spring manufacturing apparatus of the second embodiment, the wire feed apparatus 400 and the first and second tool selection apparatuses 600 and 700 are placed face to face on the base 100.

The first and second tool selection apparatuses 600 and 700 are arranged next to each other on the base 100.

Note that since the first tool selection apparatus and second tool selection apparatus have a symmetrical configuration, the following description only explains the configuration of the first tool selection apparatus 600.

A tool selection table 610, which holds plural detachable tools having different end shapes and motions in accordance with various spring sizes such as the wire diameter or coil shape or the like, is rotatably mounted on the first tool selection apparatus 600. The disk-like tool selection table 610 is mounted on a moving table, which is provided for three-dimensionally moving the tool selection table 610, for positioning a selected tool with respect to a wire.

The moving table is constructed with a front-to-back table 603 which is movable in the front-to-back direction along a front-to-back rail 602 fixed to the top surface of the base 100; an up-and-down table 606 which is movable in the up-and-down direction along an up-and-down rail 605 fixed to the top surface of the front-to-back table 603; and a horizontal table 609 which is movable in the horizontal direction along a horizontal rail 608 fixed to the side surface of the up-and-down table 606.

The front-to-back table 603 is movable along the front-to-back rail 602 by a worm screw mechanism or the like, with the use of a front-to-back driving motor 604 as a driving source. The up-and-down table 606 is movable along the up-and-down rail 605 by a worm screw mechanism or the like, with the use of an up-and-down driving motor 607 as a driving source. The horizontal table 609 is movable along the horizontal rail 608 by a worm screw mechanism or the like, with the use of a horizontal driving motor 611 as a driving source.

Since the function of the tool selection table 610 and the detailed construction of the wire feed apparatus 400 are the same as that of the first embodiment, description thereof will be omitted.

Referring to the conventional tool slide shown in FIG. 25, the movement of the front-to-back table 603 corresponds to the conventional Z-axis direction; the movement of the up-and-down table 606 corresponds to the conventional Y-axis direction; and the movement of the horizontal table 609 corresponds to the conventional X-axis direction.

Compared to the apparatus of the first embodiment, the apparatus of the second embodiment has an advantage in that the moving table is mounted on the base 100 with a greater strength. However, because the space between the wire feed apparatus 400 and the first and second tool selection apparatus is small, it is difficult to perform maintenance or monitoring, and is difficult to secure a place for receiving a cut spring as a finished product.

On the other hand, compared to the apparatus of the second embodiment, the apparatus of the first embodiment has an advantage in that it is easy to perform maintenance or monitoring, and is easy to secure a place for receiving a cut spring as a finished product, although there is a disadvantage in that the moving table is mounted on the base 100 with less strength.

Note that the present invention is applicable to corrected or modified cases of the above embodiments without departing from the spirit of the present invention.

For instance, the first and second tool selection apparatuses and wire feed apparatus according to the above embodiments may be mounted as an independent unit to other types of spring manufacturing apparatus.

Furthermore, in the above-described embodiments, only one of the first or second tool selection apparatus may be mounted.

As has been described above, according to the foregoing embodiments, by virtue of plural tools radially arranged and by having the tool selection table which rotates on an axis parallel to the wire axis line for selecting a predetermined tool from plural tools, and a moving table which moves the tool selection table in three-dimensional directions for positioning a selected tool at a predetermined position of the spring forming space, it is possible to selectably mount plural types of tools and to realize fully automated tool driving and fine and small adjustment of tool positioning by numerical control.

The present invention is not limited to the above embodiments and various changes and modifications can be made within the spirit and scope of the present invention. Therefore, to apprise the public of the scope of the present invention, the following claims are made.

What is claimed is:

1. A spring manufacturing apparatus for manufacturing a spring by feeding a wire, to be formed into a spring, from an end portion of a wire guide, and forcefully bending, winding, or coiling the wire by tools in a spring forming space near the end of the wire guide, comprising:

wire feed means for feeding the wire toward the spring forming space;

a tool selection table, on which the plural tools are radially mounted, rotatable about an axis substantially parallel to a wire axis line so as to enable selection of a predetermined tool from the plural tools;

selection table driving means for rotating said tool selection table;

a moving table for moving said tool selection table in three-dimensional directions for positioning the selected tool at a predetermined position of the spring forming space;

moving table driving means for moving said moving table; and control means for controlling said selection table driving means and said moving table driving means in accordance with a forming procedure of the spring.

2. The spring manufacturing apparatus according to claim 1, further comprising:

supporting means for supporting the wire guide so as to be rotatable on the wire axis line; and guide driving means for rotating the wire guide.

3. The spring manufacturing apparatus according to claim 1, wherein said moving table comprises:

a Z table movable in a first direction which is parallel to the wire axis line;

a X table movable in a second direction which is perpendicular to the first direction; and a Y table movable in a third direction which is perpendicular to the first and second directions.

4. The spring manufacturing apparatus according to claim 1, wherein said tool selection table supports different types of detachable tools.

5. The spring manufacturing apparatus according to claim 1, wherein a rotation tool, rotatable on a coiling axis for coiling a wire on the coiling axis, is mounted on said tool selection table.

6. The spring manufacturing apparatus according to claim 1, wherein a set of said tool selection table and said moving table is symmetrical to another set of said tool selection table and said moving table with respect to the wire axis line.

7. The spring manufacturing apparatus according to claim 1, wherein a set of said tool selection table and said moving table is symmetrical to another set of said tool selection table and said moving table, and the sets of said tool selection table and said moving table are positioned face to face with the end portion of the wire guide.

8. The spring manufacturing apparatus according to claim 1, further comprising revolving means for revolving said wire feed means around the wire axis line, while said wire feed means is gripping the wire.

9. The spring manufacturing apparatus according to claim 8, wherein said revolving means revolves said wire feed means gripping the wire so as to twist the wire and changes a wire direction fed from the wire guide.

10. The spring manufacturing apparatus according to claim 1, wherein the wire guide is arranged in the substantial center of a frame which is extended upward from the apparatus main body, and slide tools slidable toward the spring forming space are arranged face to face with each other above and below the wire guide.

11. The spring manufacturing apparatus according to claim 10, wherein said slide tools at least serve as a cutting tool.

12. A tool selection apparatus embodied in a spring manufacturing apparatus which manufactures a spring by feeding a wire, to be formed into a spring, from an end portion of a wire guide, and forcefully bending, winding, or coiling the wire by tools in a spring forming space near the end of the wire guide, comprising:

a tool selection table, on which the plural tools are radially mounted, rotatable about an axis substantially parallel to a wire axis line so as to enable selection of a predetermined tool from the plural tools;

selection table driving means for rotating said tool selection table;

a moving table for moving said tool selection table in three-dimensional directions for positioning the selected tool at a predetermined position of the spring forming space; and moving table driving means for moving said moving table.

13. The tool selection apparatus according to claim 12, wherein said moving table comprises:

a Z table movable in a first direction which is parallel to the wire axis line;

a X table movable in a second direction which is perpendicular to the first direction; and a Y table movable in a third direction which is perpendicular to the first and second directions.

14. The tool selection apparatus according to claim 12, wherein said tool selection table supports different types of detachable tools.

15. The tool selection apparatus according to claim 12, wherein a rotation tool, rotatable on a coiling axis for coiling a wire on the coiling axis, is mounted on said tool selection table.

16. The tool selection apparatus according to claim 12, wherein a set of said tool selection table and said moving table is symmetrical to another set of said tool selection table and said moving table with respect to the wire axis line.

17. The tool selection apparatus according to claim 12, wherein a set of said tool selection table and said moving table is symmetrical to another set of said tool selection table and said moving table, and the sets of said tool selection table and said moving table are positioned face to face with the end portion of the wire guide.

* * * * *